US011890501B2

(12) United States Patent
Azzam

(10) Patent No.: US 11,890,501 B2
(45) Date of Patent: Feb. 6, 2024

(54) MULTI-USE EXERCISE APPARATUS

(71) Applicant: Strosion, LLC, Cary, NC (US)

(72) Inventor: Nizar F. Azzam, Cary, NC (US)

( * ) Notice: Subject to any disclaimer, the term of this patent is extended or adjusted under 35 U.S.C. 154(b) by 0 days.

(21) Appl. No.: 17/659,111

(22) Filed: Apr. 13, 2022

(65) Prior Publication Data

US 2022/0339491 A1 Oct. 27, 2022

Related U.S. Application Data

(60) Provisional application No. 63/178,293, filed on Apr. 22, 2021.

(51) Int. Cl.

| | |
|---|---|
| ***A63B 21/00*** | (2006.01) |
| ***A63B 23/12*** | (2006.01) |
| ***A63B 21/16*** | (2006.01) |
| ***A47B 23/04*** | (2006.01) |

(52) U.S. Cl.

CPC ..... *A63B 21/4035* (2015.10); *A63B 21/16* (2013.01); *A63B 23/1236* (2013.01); *A47B 23/04* (2013.01); *A63B 2208/0204* (2013.01); *A63B 2208/0295* (2013.01)

(58) Field of Classification Search

CPC ..... A47B 23/04; A63B 21/00047; A63B 21/00185; A63B 21/068; A63B 21/16; A63B 21/4027; A63B 21/4033; A63B 21/4035; A63B 21/4039; A63B 23/12; A63B 23/1209; A63B 23/1236; A63B 2208/0204; A63B 2208/0295

See application file for complete search history.

(56) References Cited

U.S. PATENT DOCUMENTS

| | | | | | |
|---|---|---|---|---|---|
| 4,123,029 | A * | 10/1978 | Gillotti | A47B 23/06 | 248/453 |
| 4,621,806 | A * | 11/1986 | Wheeler | A63B 23/12 | 482/141 |
| 4,880,327 | A * | 11/1989 | Sanabria | B42F 13/402 | 402/73 |
| 5,029,798 | A * | 7/1991 | Clark | A47B 23/044 | 206/45.24 |
| 5,181,897 | A * | 1/1993 | Agan | A63B 21/4035 | 482/141 |
| D332,981 | S * | 2/1993 | Poli | D21/686 | |
| 5,230,684 | A * | 7/1993 | Wallisch | A63B 23/12 | 482/141 |
| D354,100 | S * | 1/1995 | Tsay | D21/686 | |
| 5,527,252 | A * | 6/1996 | Sather | A63B 21/00047 | 482/141 |
| D380,629 | S * | 7/1997 | Shinno | D6/682.3 | |
| 6,386,500 | B1 * | 5/2002 | Dainoff | A47B 23/042 | 248/456 |

(Continued)

FOREIGN PATENT DOCUMENTS

| | | | | |
|---|---|---|---|---|
| CN | 112293949 A * | 2/2021 | A47B 23/00 | |
| JP | 2015020052 A * | 2/2015 | A63B 23/12 | |

(Continued)

*Primary Examiner* — Gary D Urbiel Goldner

(57) ABSTRACT

A multi-use exercise apparatus is disclosed. The multi-use exercise apparatus and methods of the invention may provide a means for performing both counter or standing push-ups and/or floor push-ups. The multi-use exercise device may include a base member or portion, a foot member or portion, and a hand member or portion.

6 Claims, 24 Drawing Sheets

(56) References Cited

U.S. PATENT DOCUMENTS

| | | | | |
|---|---|---|---|---|
| 8,343,021 | B1 * | 1/2013 | Seraydarian | A63B 71/04 482/141 |
| 9,022,330 | B2 * | 5/2015 | Heersink | A47F 5/0853 248/220.31 |
| 9,308,767 | B1 * | 4/2016 | Waldron | B42D 15/042 |
| 9,314,662 | B1 * | 4/2016 | Willison | A63B 21/4035 |
| 9,895,920 | B2 * | 2/2018 | Zarley | B42D 3/10 |
| 11,027,568 | B2 * | 6/2021 | Zarley | B42B 5/10 |
| 11,077,335 | B2 * | 8/2021 | McRann | A63B 21/4043 |
| 2015/0290486 | A1 * | 10/2015 | Leone | A63B 23/1236 482/96 |
| 2016/0325135 | A1 * | 11/2016 | Franche | A63B 71/0054 |
| 2017/0360200 | A1 * | 12/2017 | Cohen | F16M 11/22 |
| 2018/0169468 | A1 * | 6/2018 | Barrie | A63B 21/4035 |
| 2019/0168060 | A1 * | 6/2019 | Laurence | A63B 21/4035 |
| 2019/0224526 | A1 * | 7/2019 | Barrie | A63B 23/1236 |
| 2020/0061412 | A1 * | 2/2020 | Crosswell | A63B 23/1236 |
| 2020/0094102 | A1 * | 3/2020 | McRann | A63B 21/169 |
| 2021/0121732 | A1 * | 4/2021 | Cotton | A63B 23/1236 |
| 2021/0178216 | A1 * | 6/2021 | Ducato | A63B 23/1236 |
| 2022/0233915 | A1 * | 7/2022 | Allen | A63B 21/068 |

FOREIGN PATENT DOCUMENTS

| | | | | |
|---|---|---|---|---|
| JP | 7060350 | B2 * | 4/2022 | A63B 21/06 |
| KR | 20180018191 | A * | 2/2018 | A63B 21/06 |

* cited by examiner (SIDE)

Multi-use exercise device 300

Structure 300

MULTI-USE EXERCISE APPARATUS

CLAIM FOR PRIORITY

This application claims priority to U.S. Provisional Patent Application Ser. No. 63/178,293, titled MULTI-USE EXERCISE APPARATUS AND METHODS OF USING SAME, filed in the U.S.P.T.O. on Apr. 22, 2021, the entire content of which is incorporated herein by reference.

TECHNICAL FIELD

The subject matter of the present invention relates generally to exercise equipment and more particularly to a multi-use exercise apparatus and methods of using same.

BACKGROUND

Exercise routines may include push-ups. However, push-ups on the floor can be difficult for beginners and therefore beginners may need to start with knee push-ups. Unfortunately, many get discouraged from going down on their knees and then getting up for breaks between sets. Current push-up devices are limited to floor push-ups and are hard to perform especially for beginners. Additionally, bare hand push-ups and some of the currently available push-up devices can cause strain on the wrists that, if not performed correctly, may result in injury.

BRIEF DESCRIPTION OF THE DRAWINGS

Figure 1:
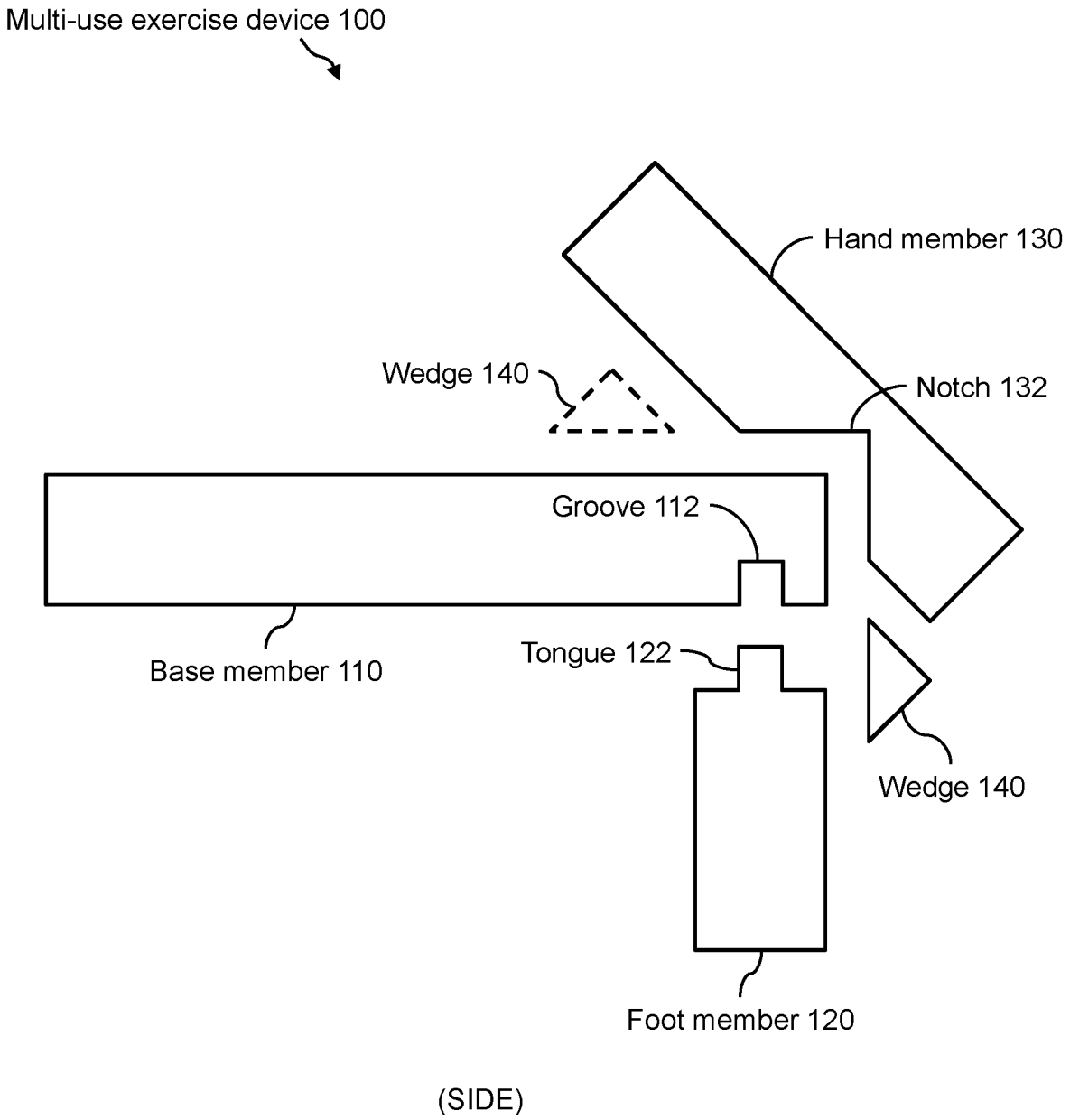
Figure 2:
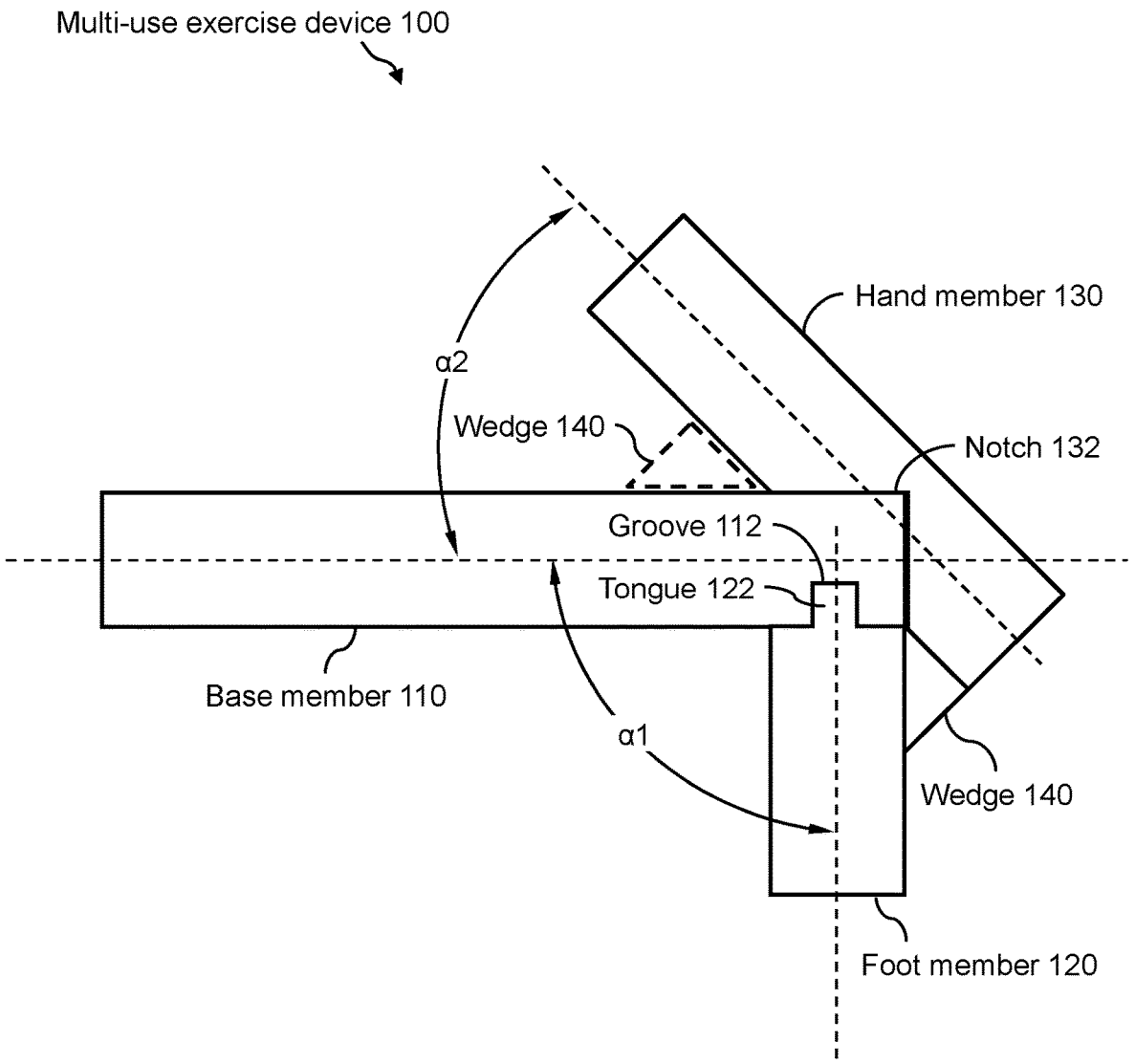
Figure 3:
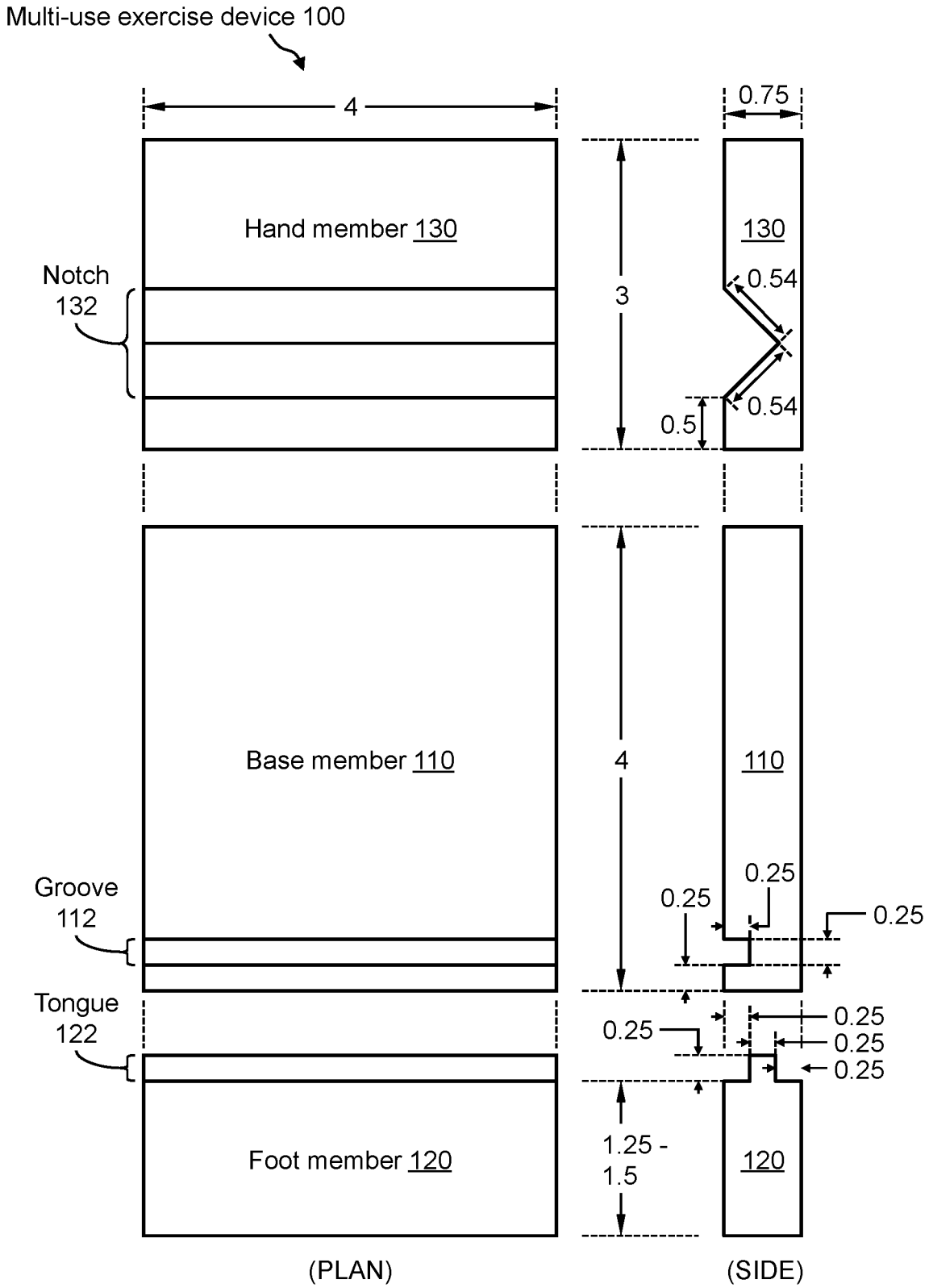
Figure 4:
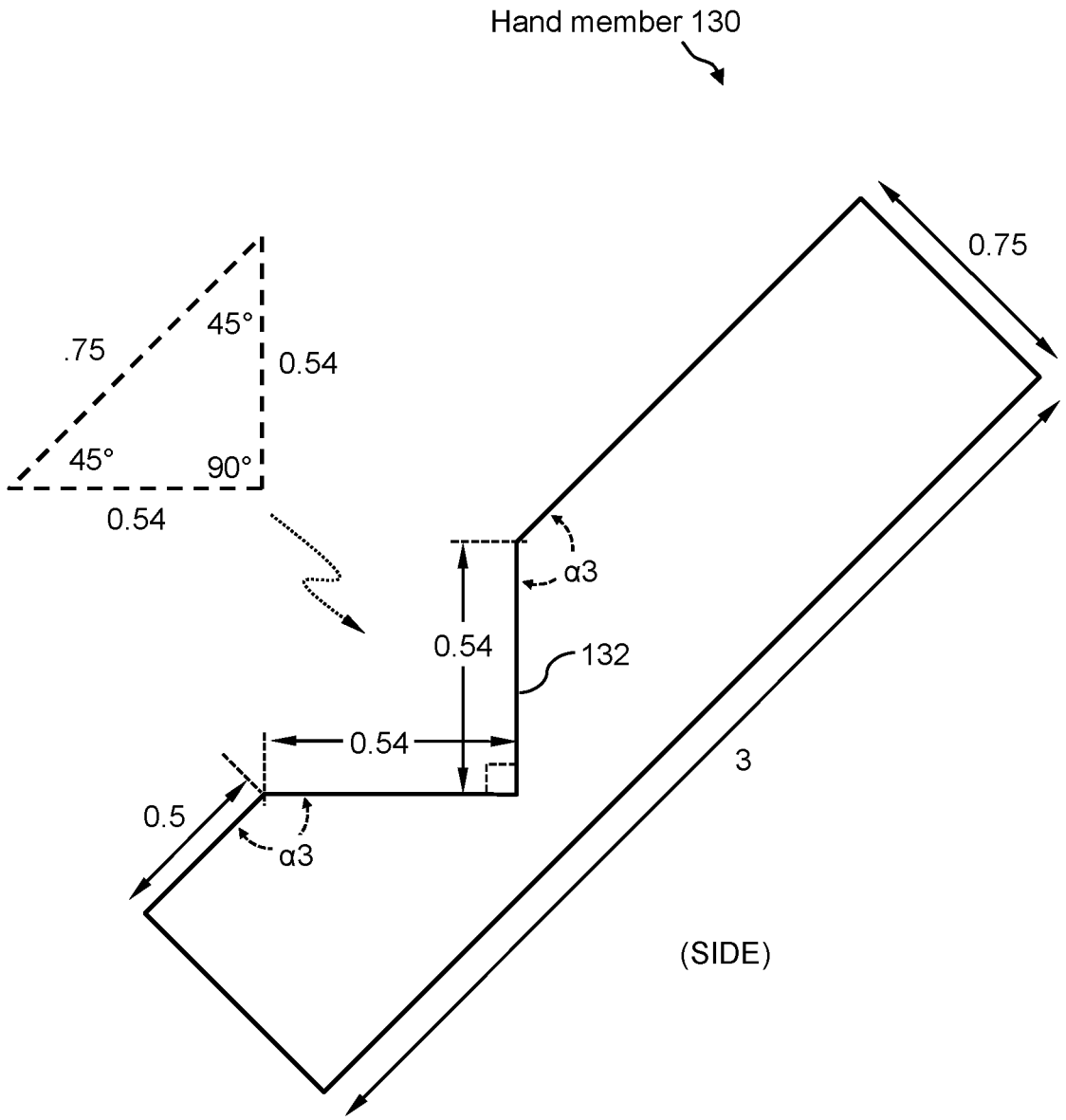
Figure 5:
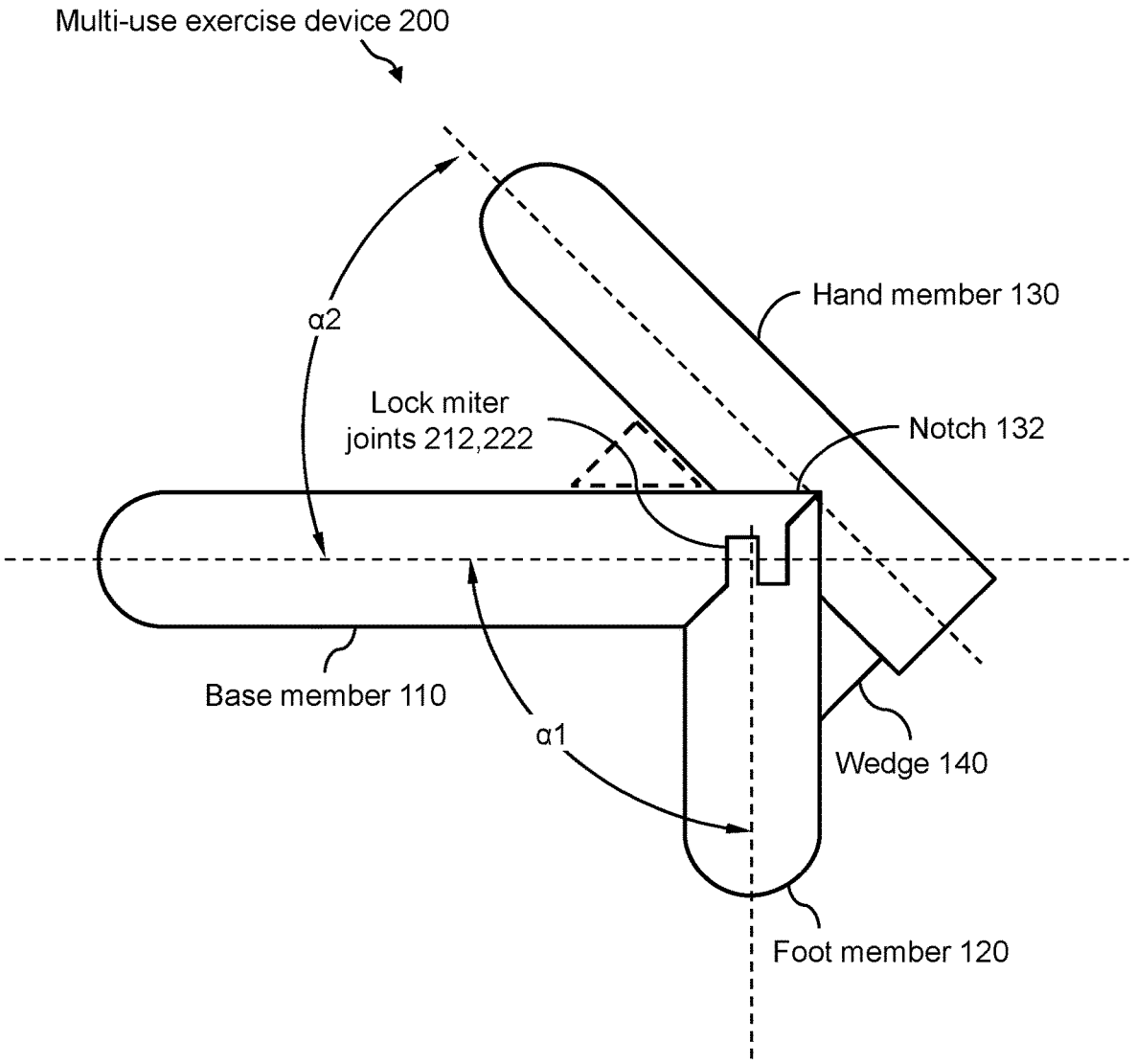
Figure 6:
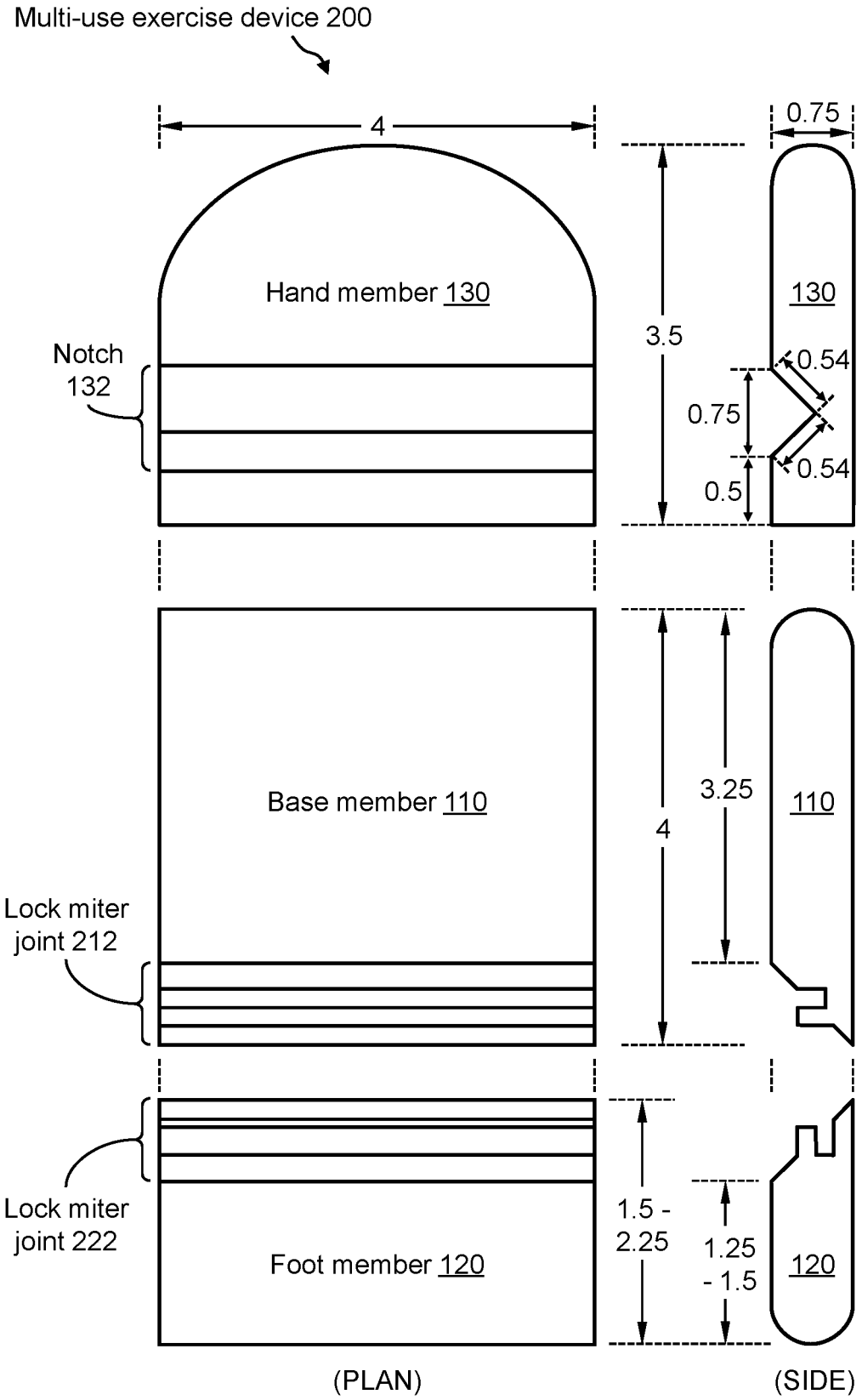
Figure 7:
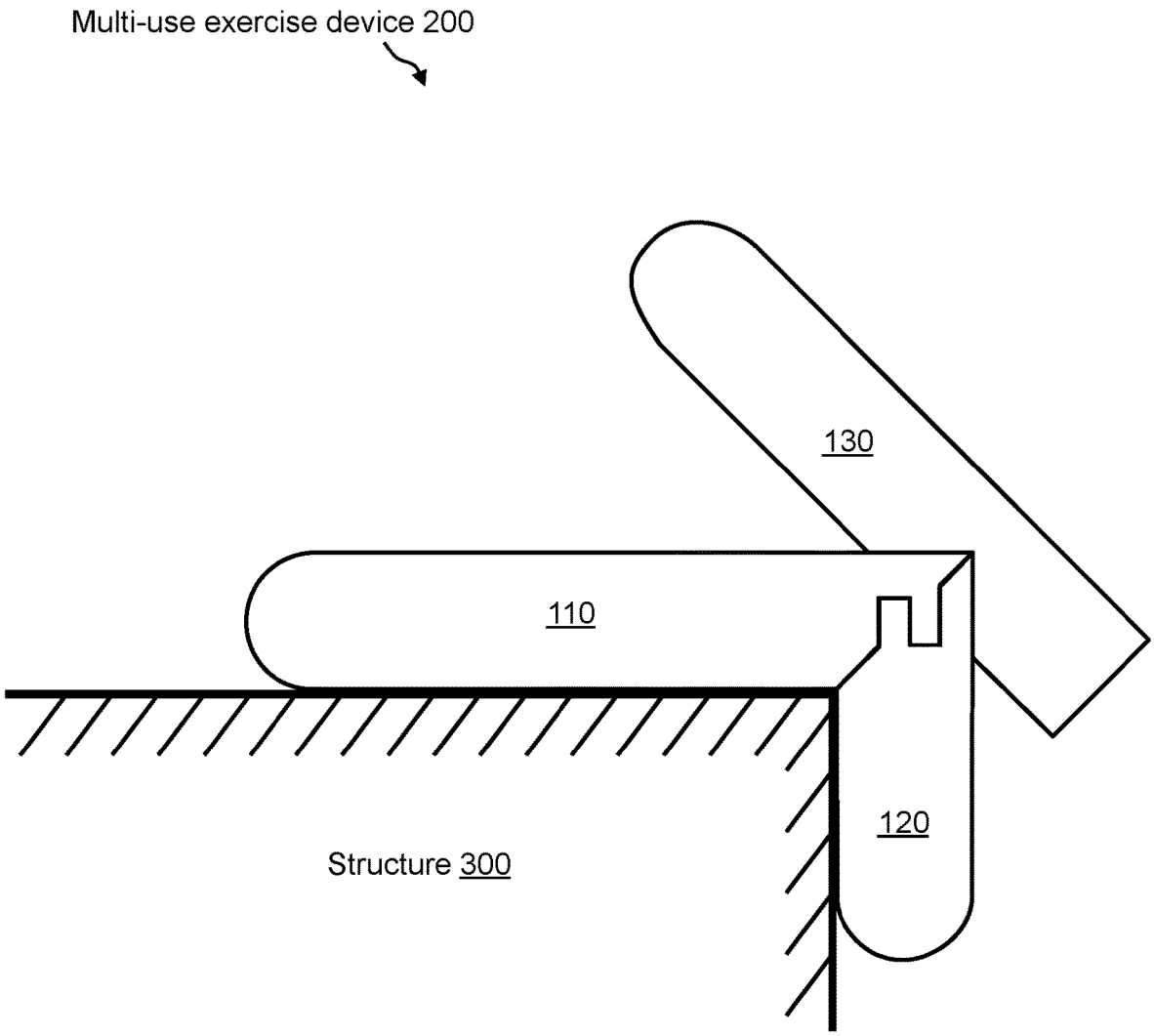
Figure 8:
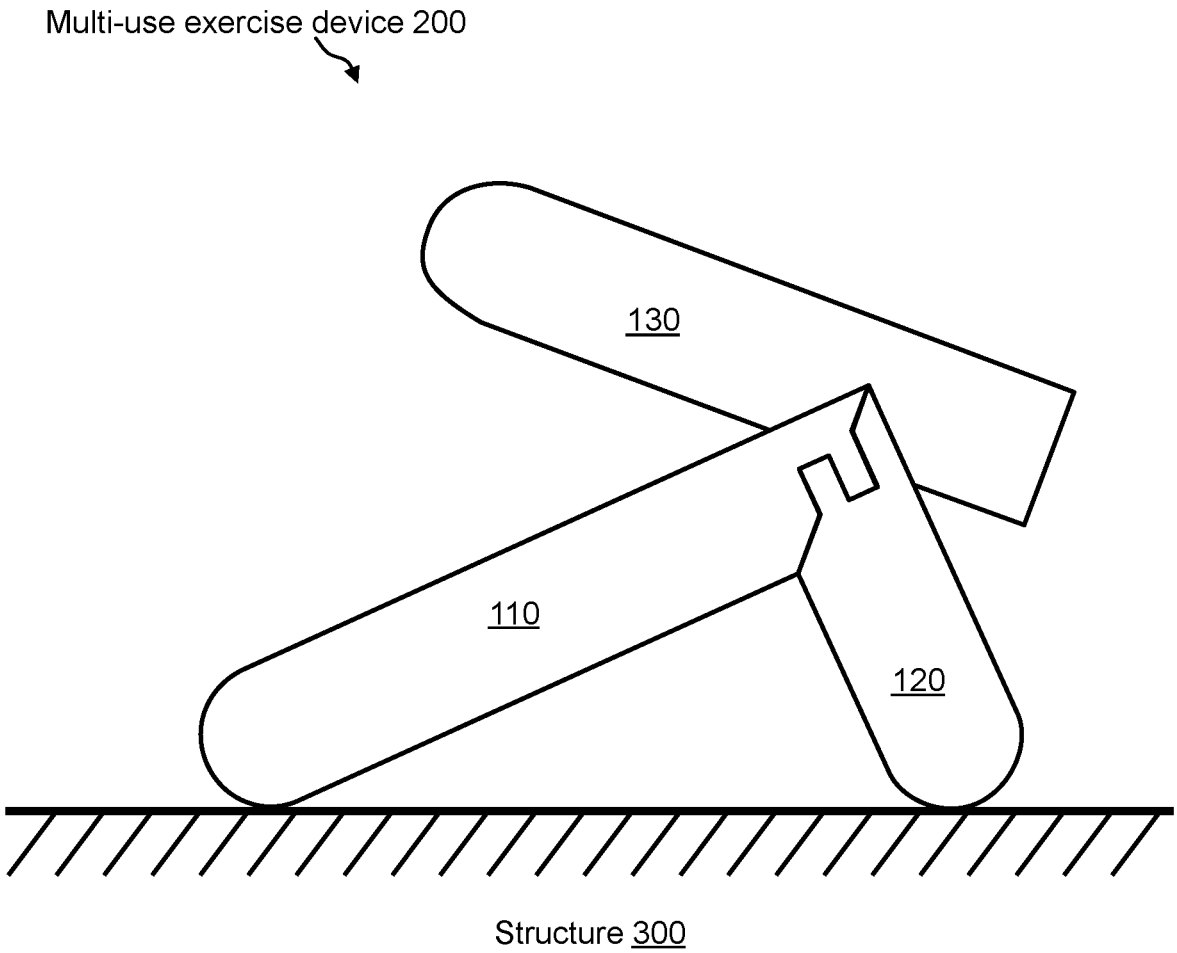
Figure 9:
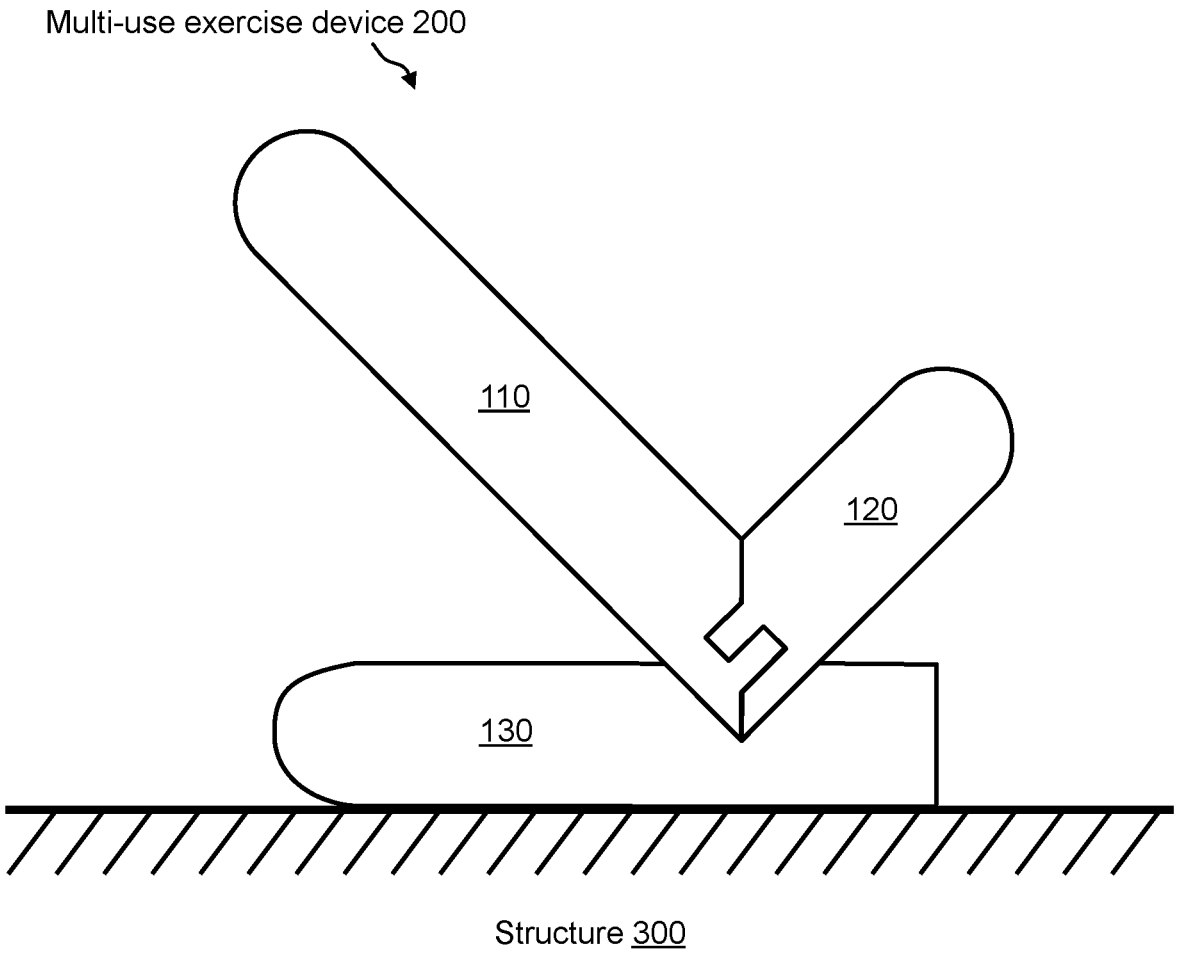
Figure 10:
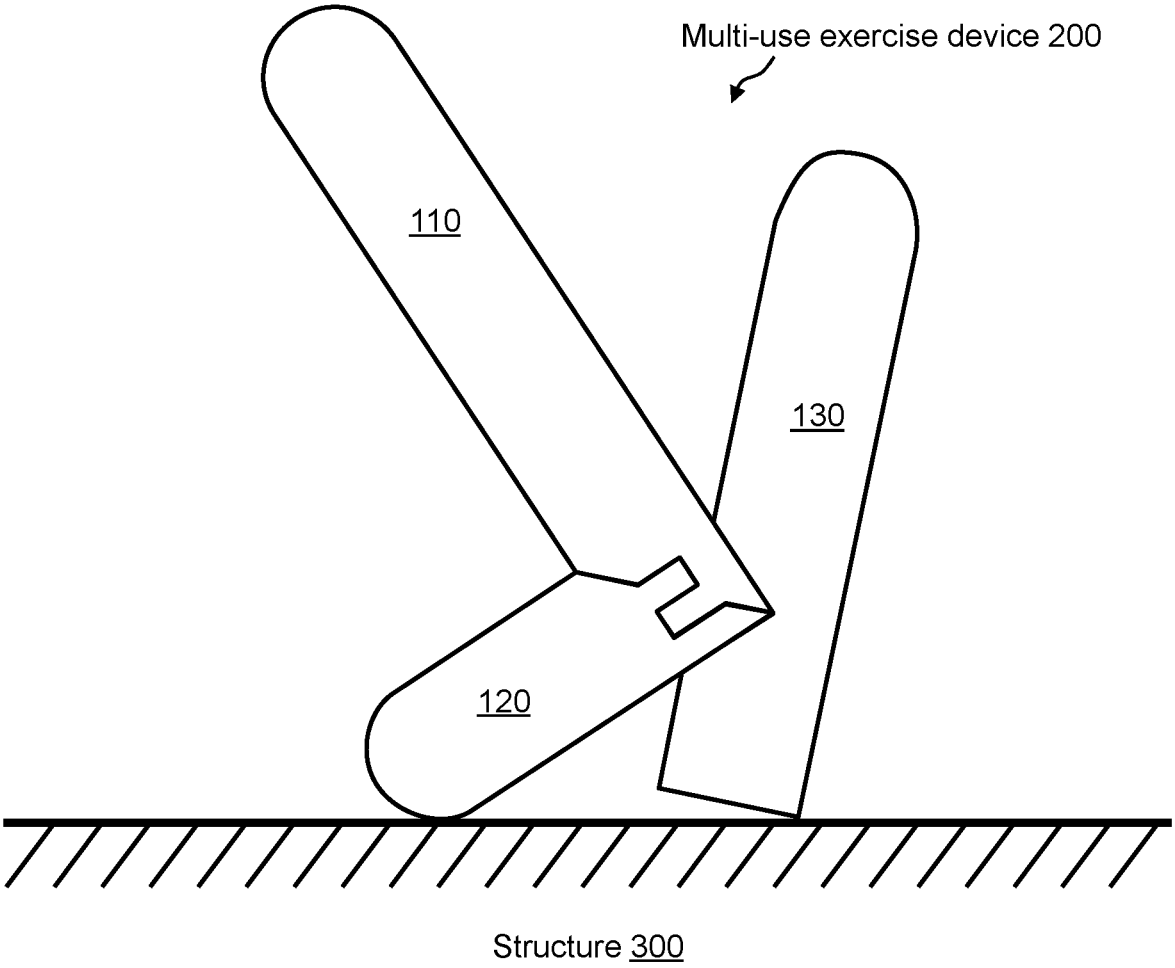
Figure 11:
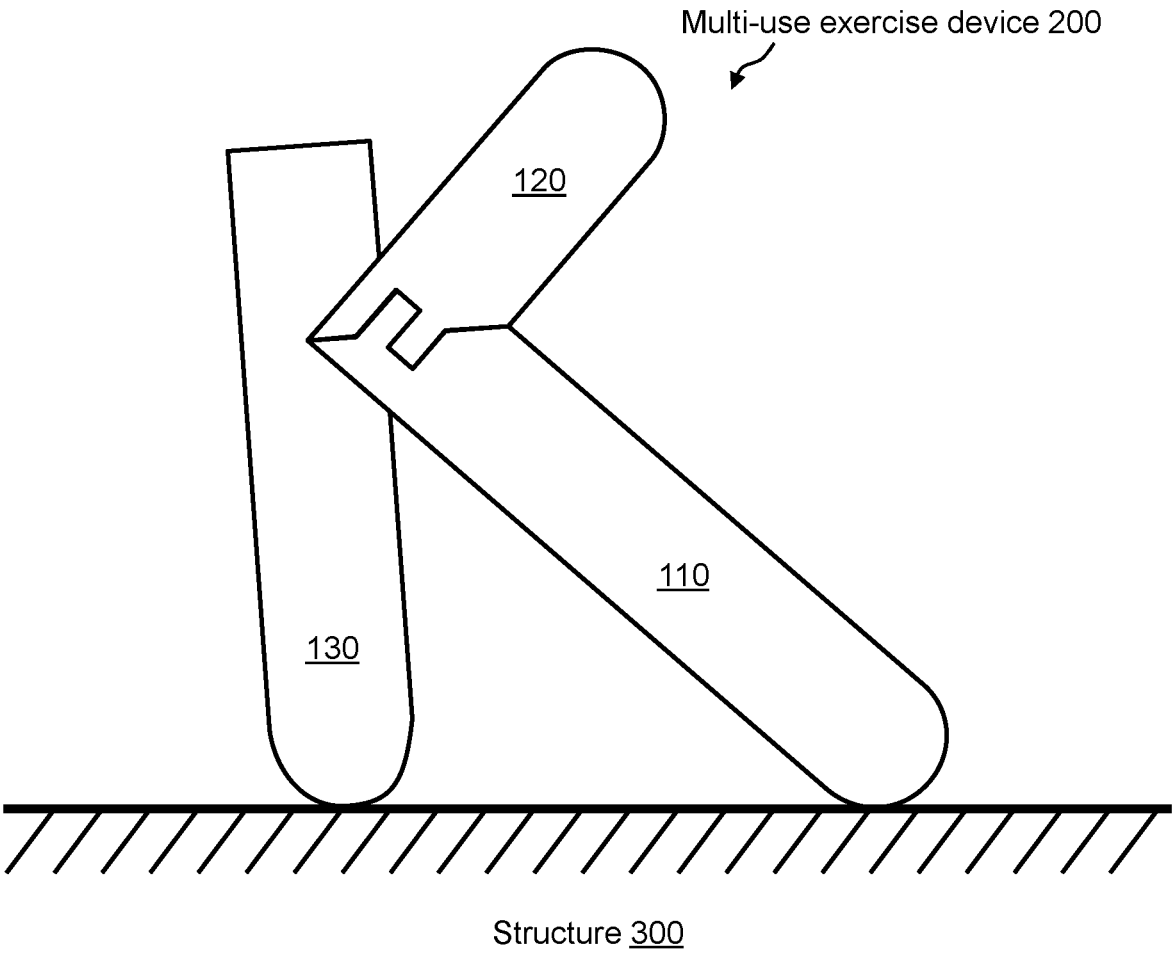
Figure 12:
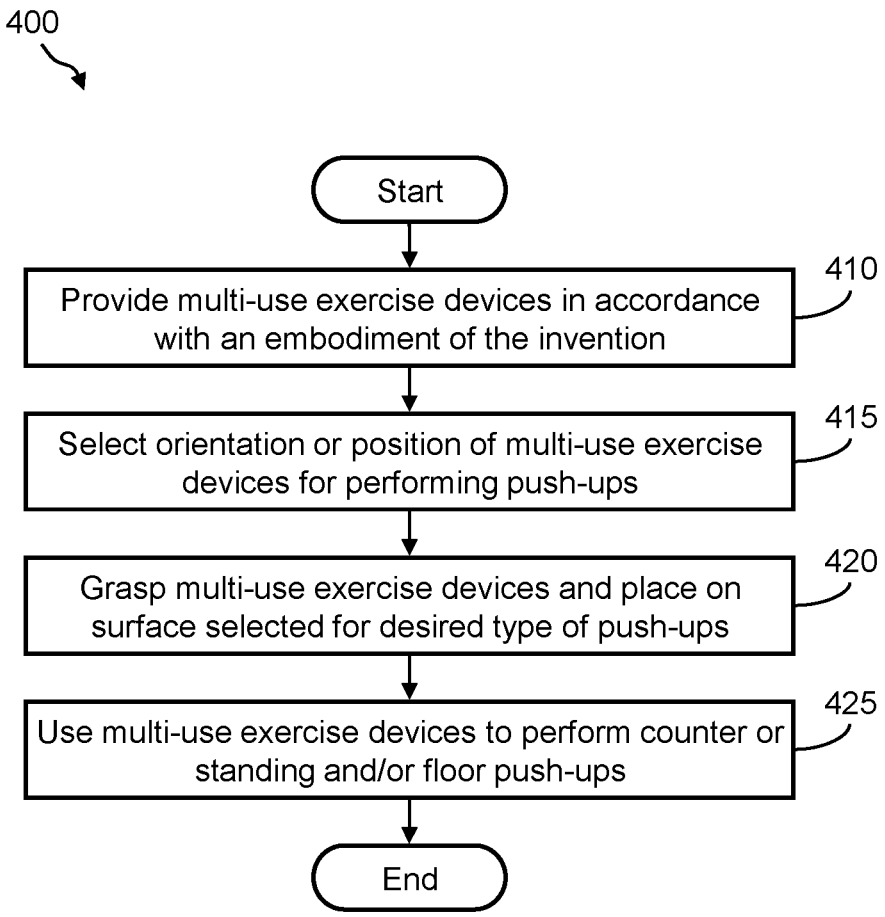
Figure 13A:
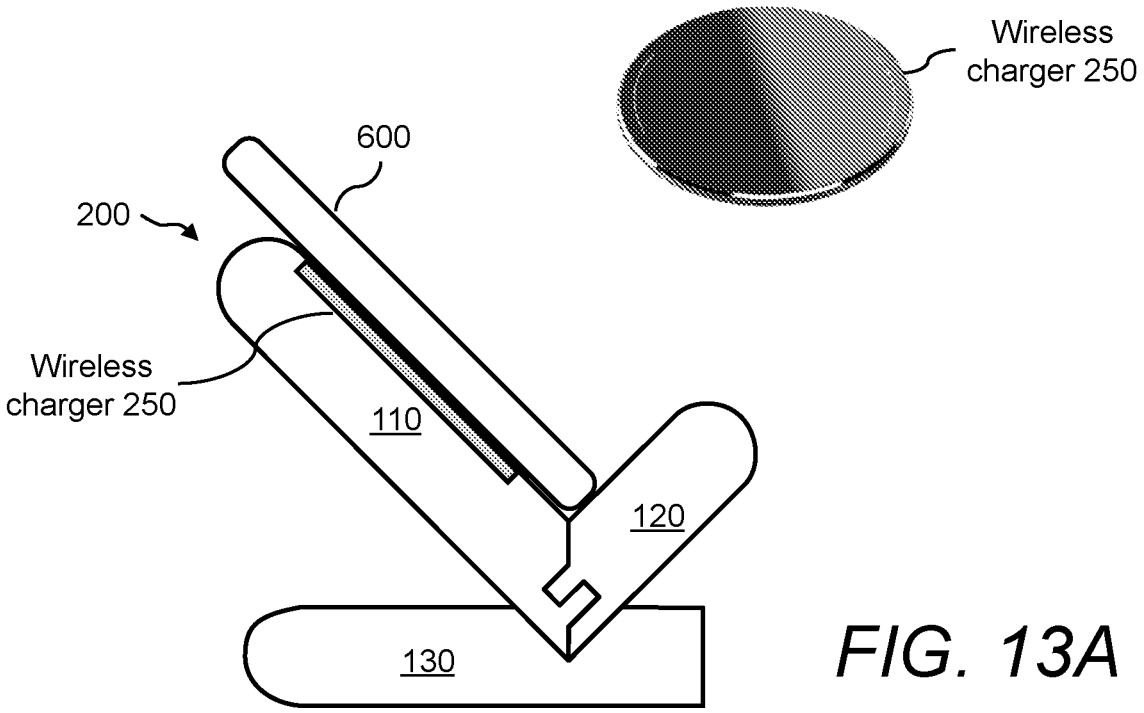
Figure 13B:
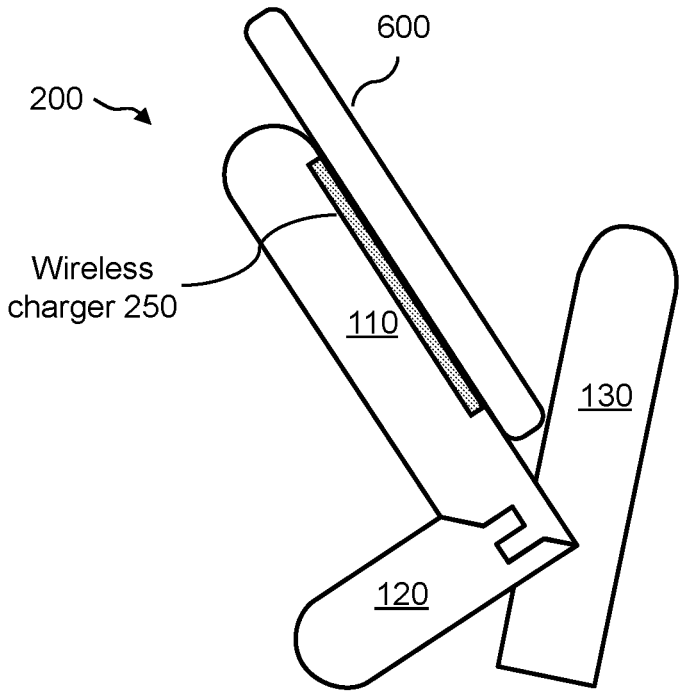
Figure 14:
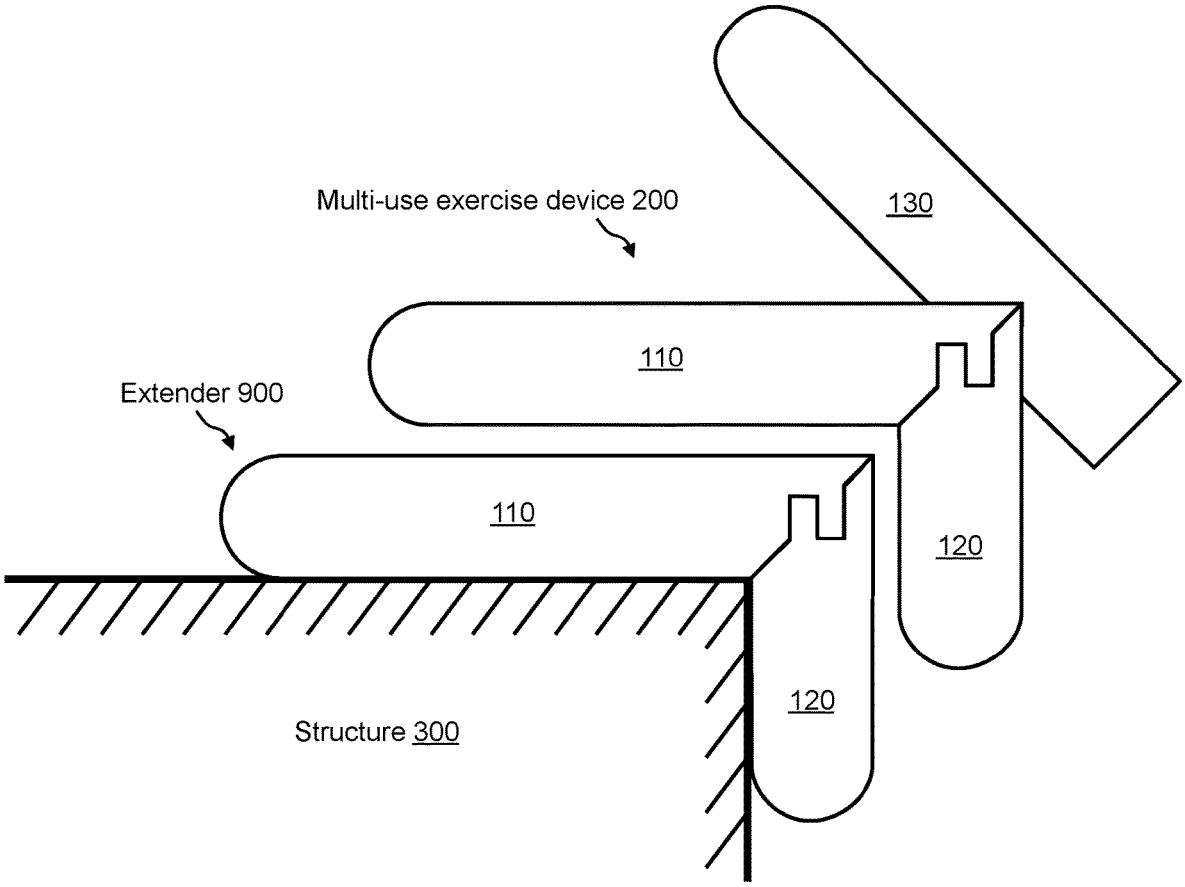
Figure 15:
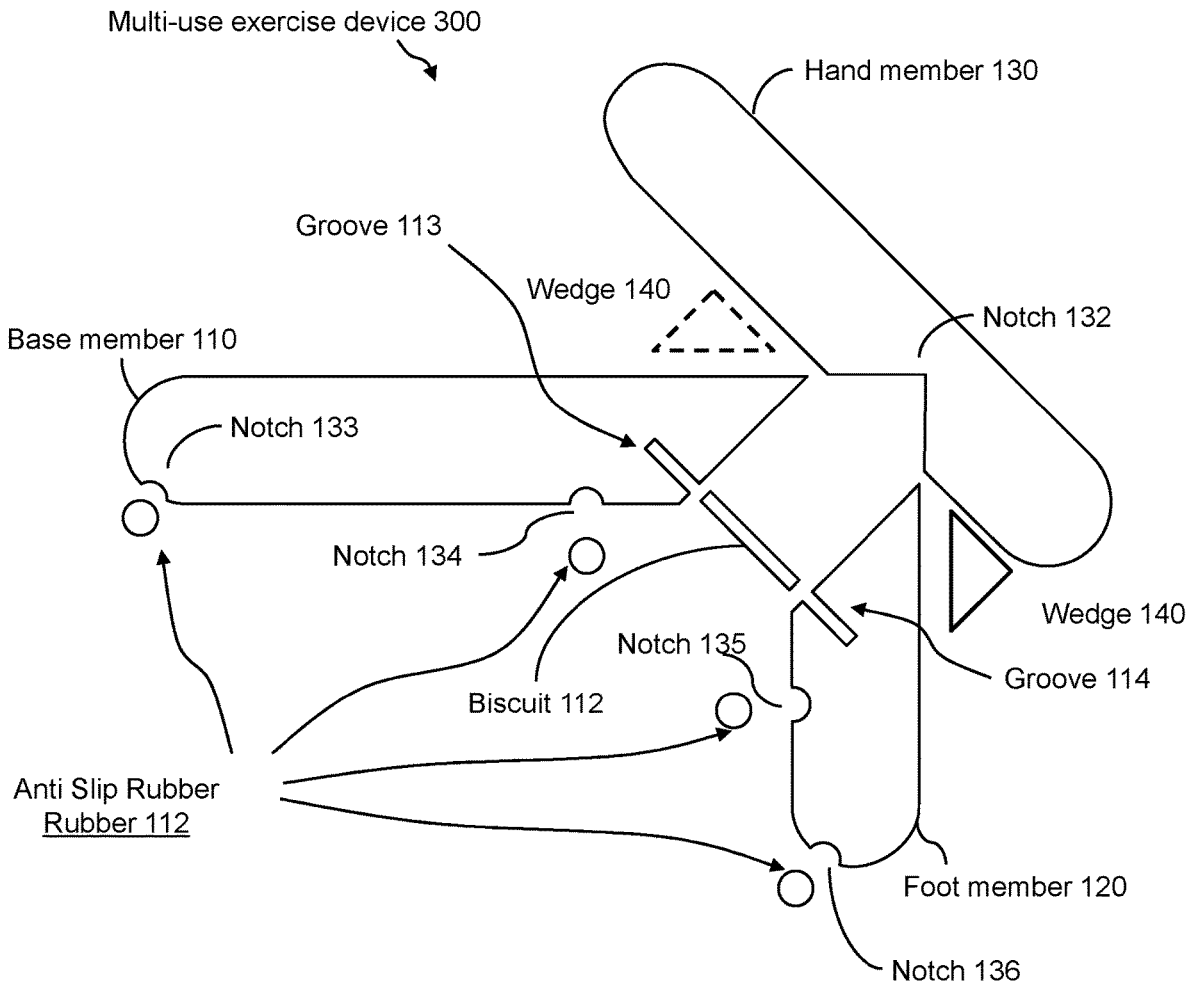
Figure 16:
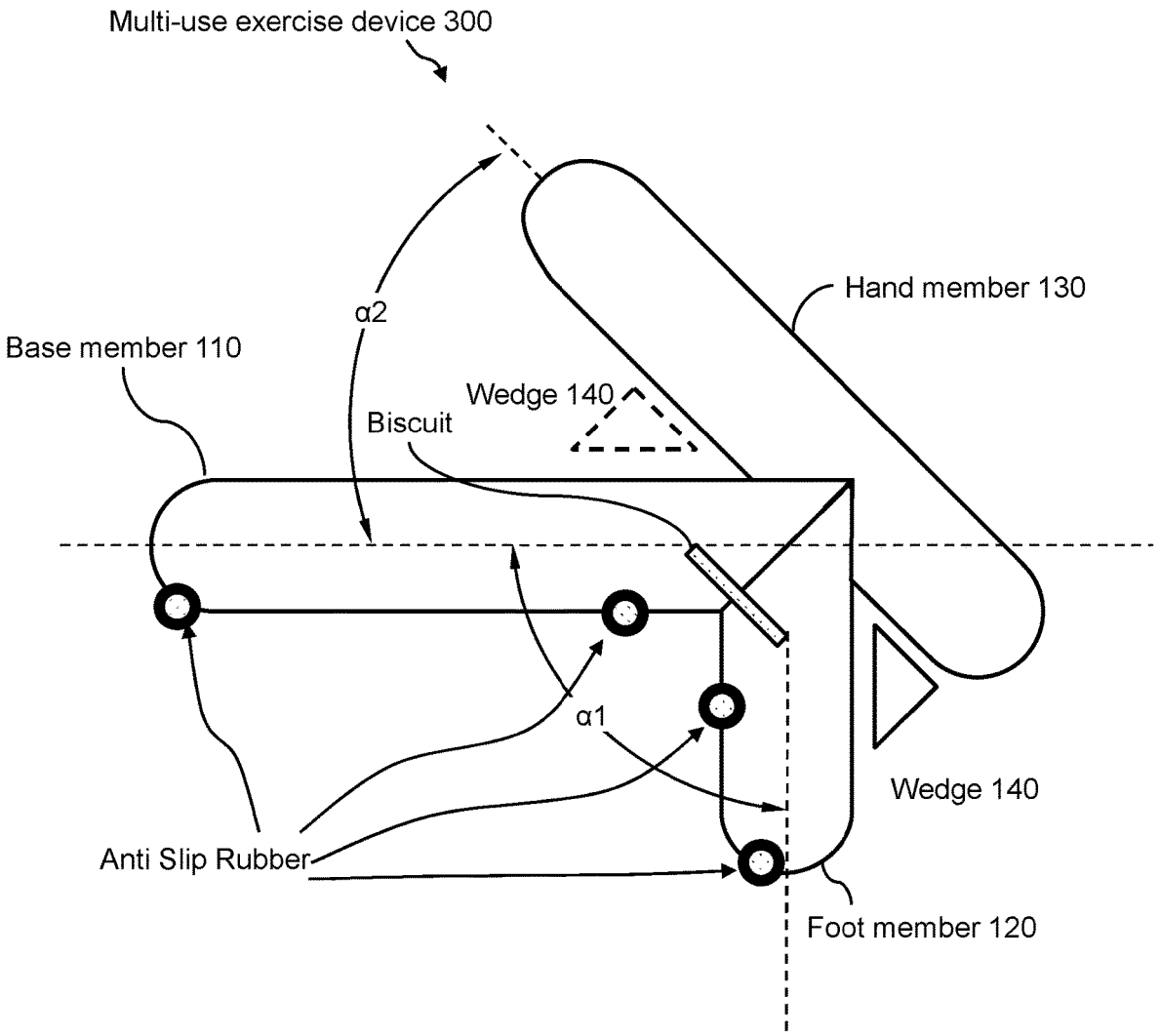
Figure 17:
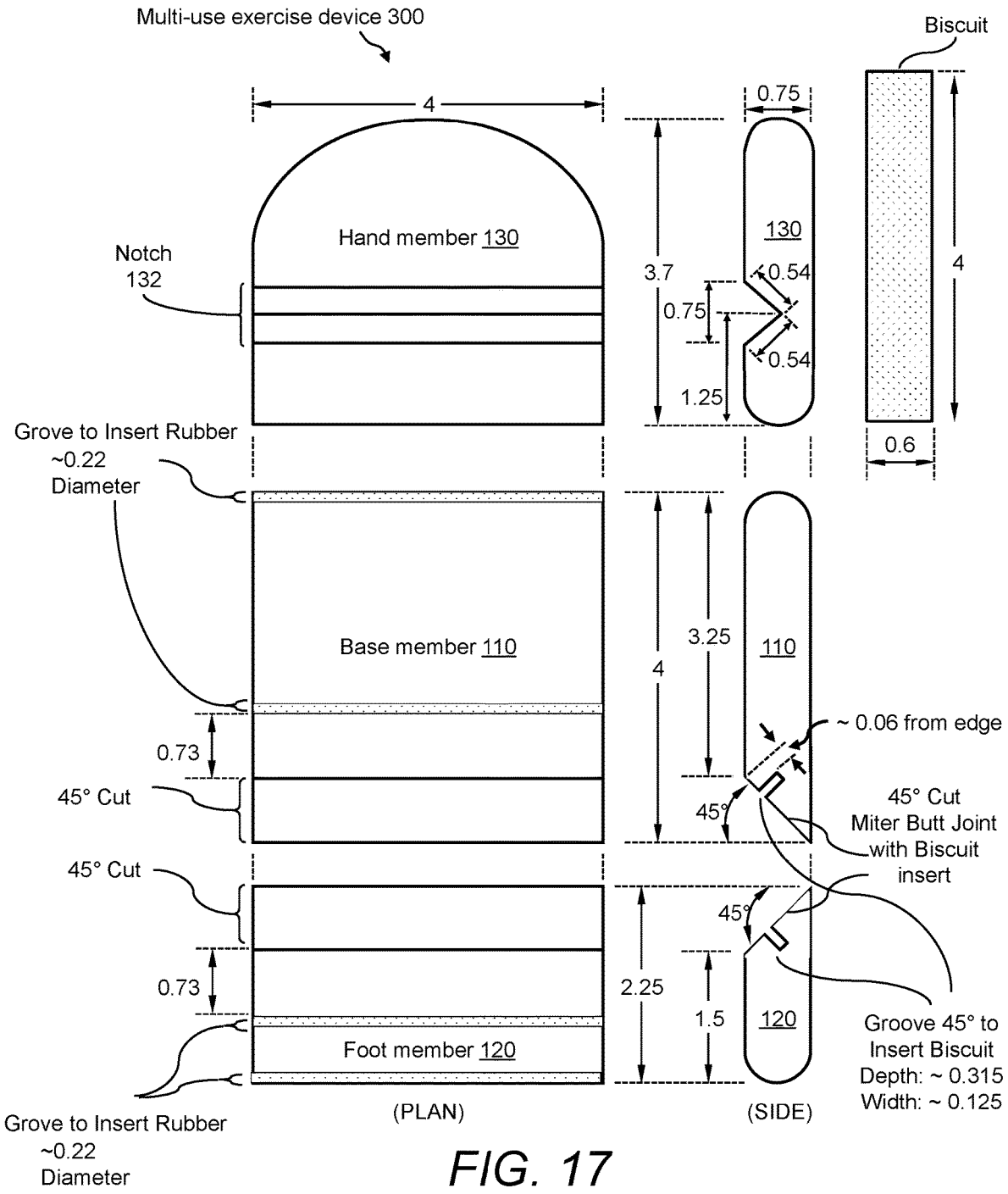
Figure 18:
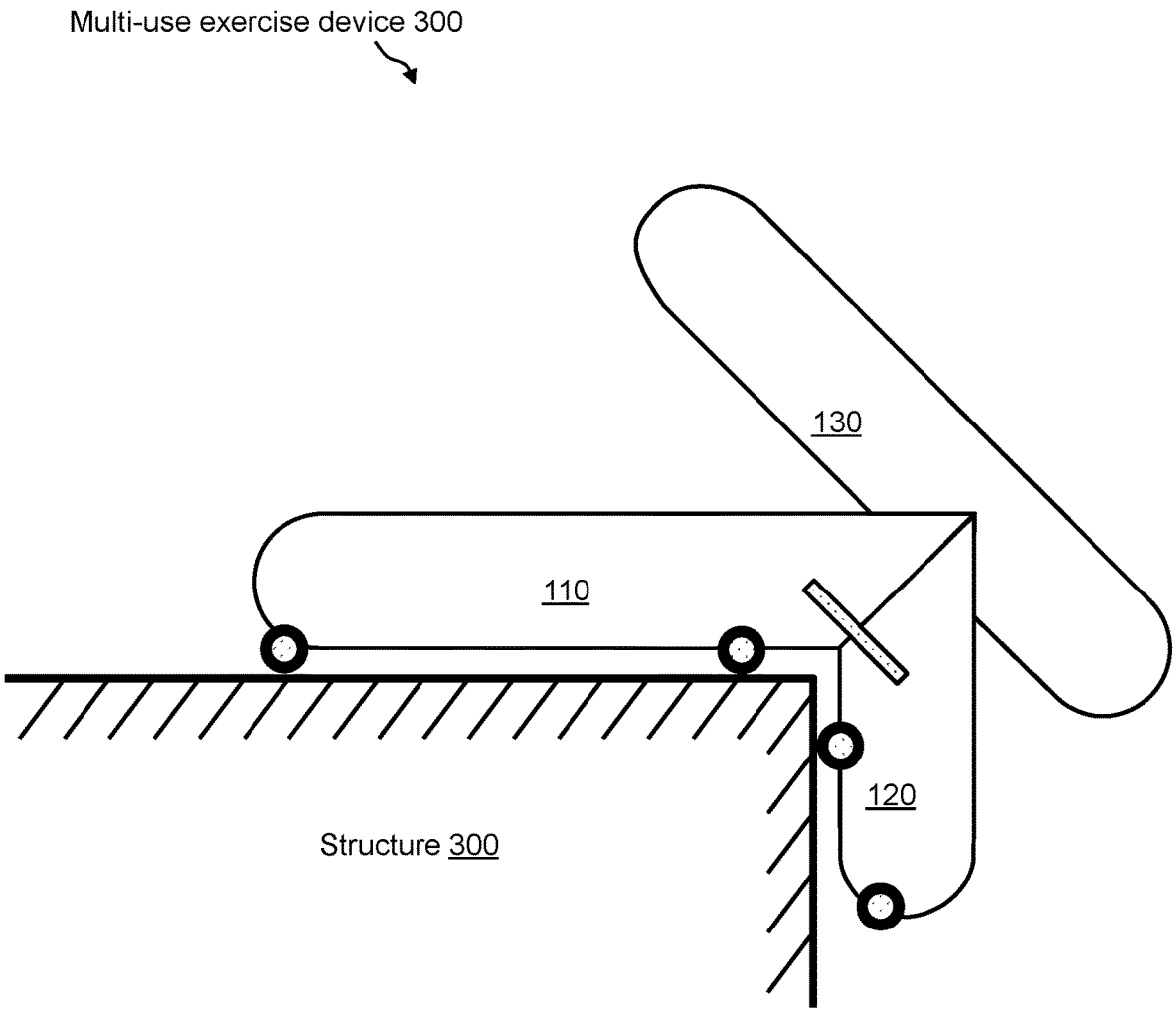
Figure 19:
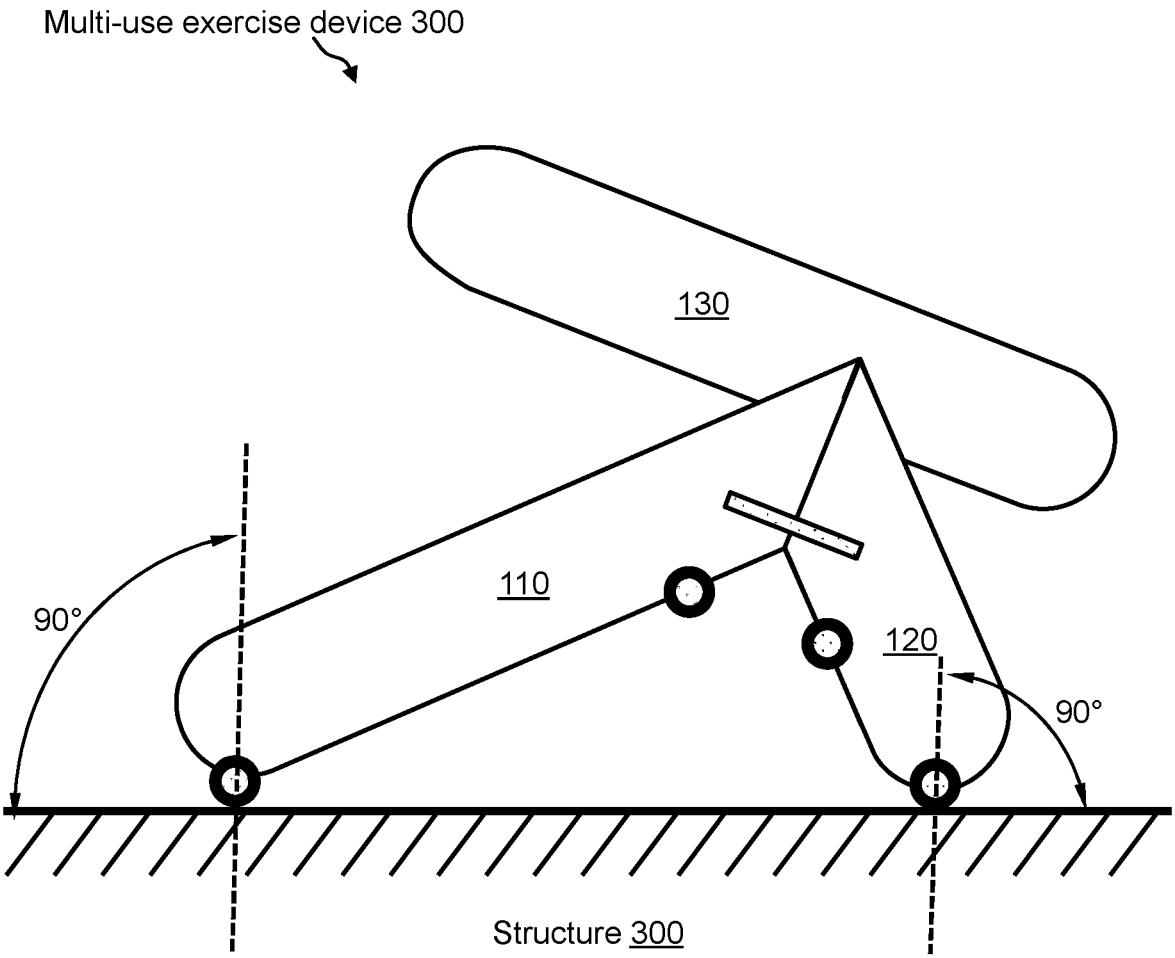
Figure 20:
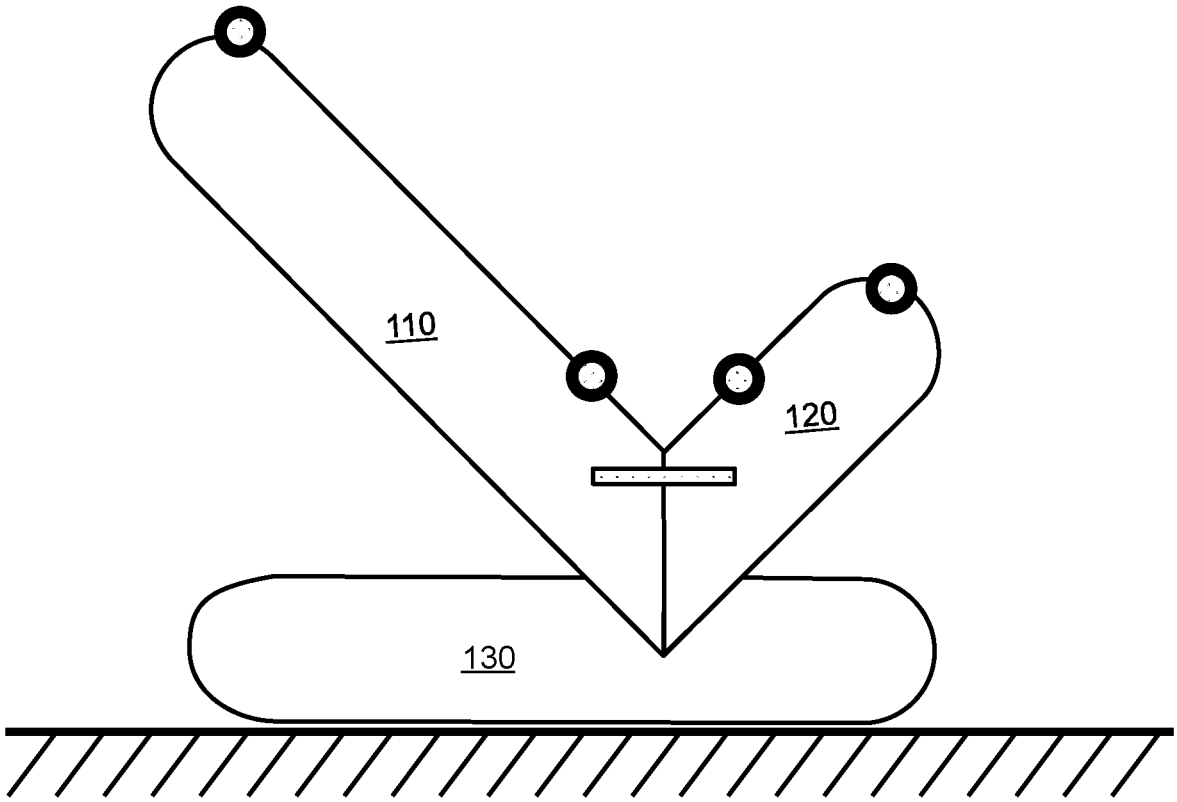
Figure 21:
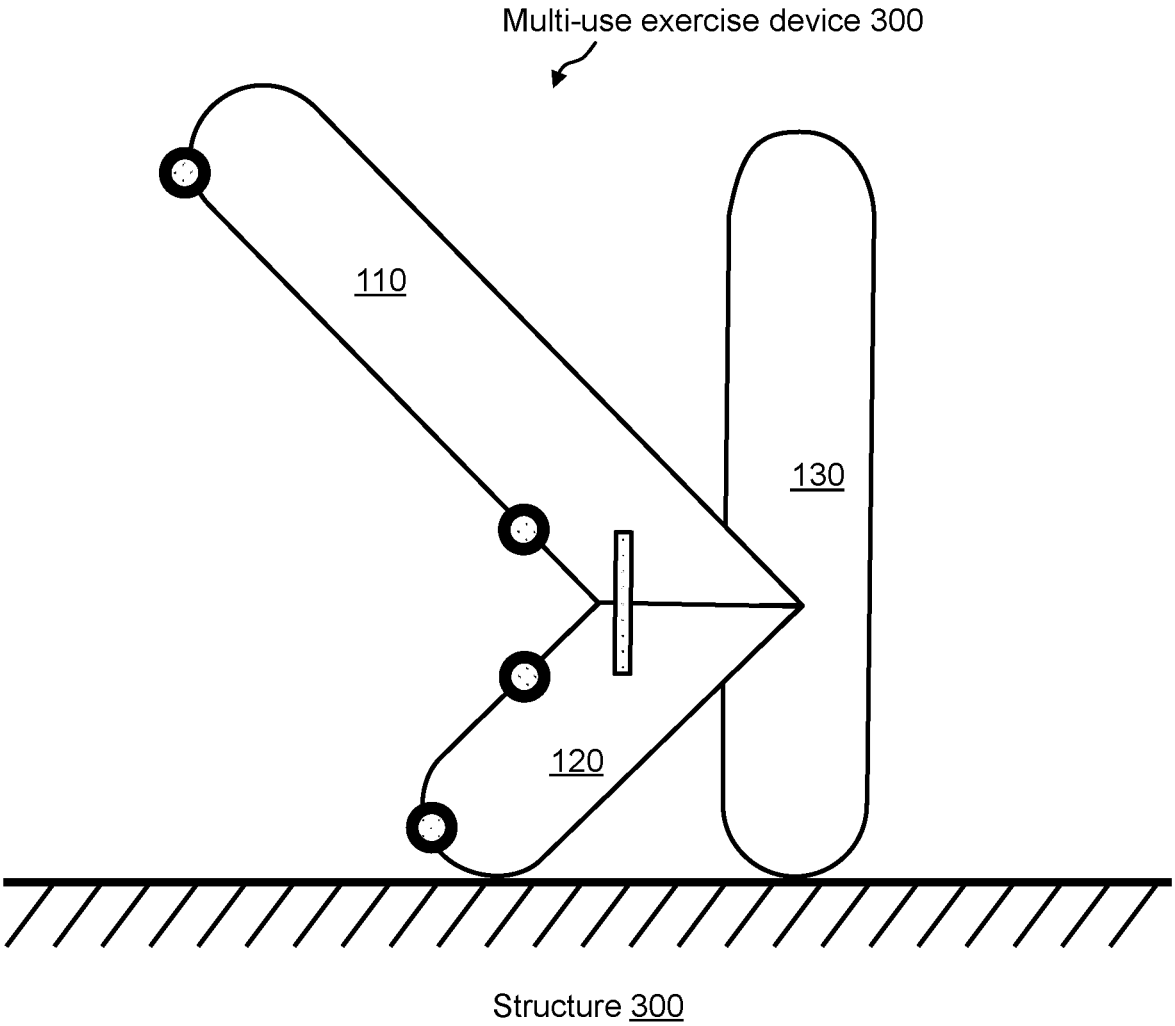
Figure 22:
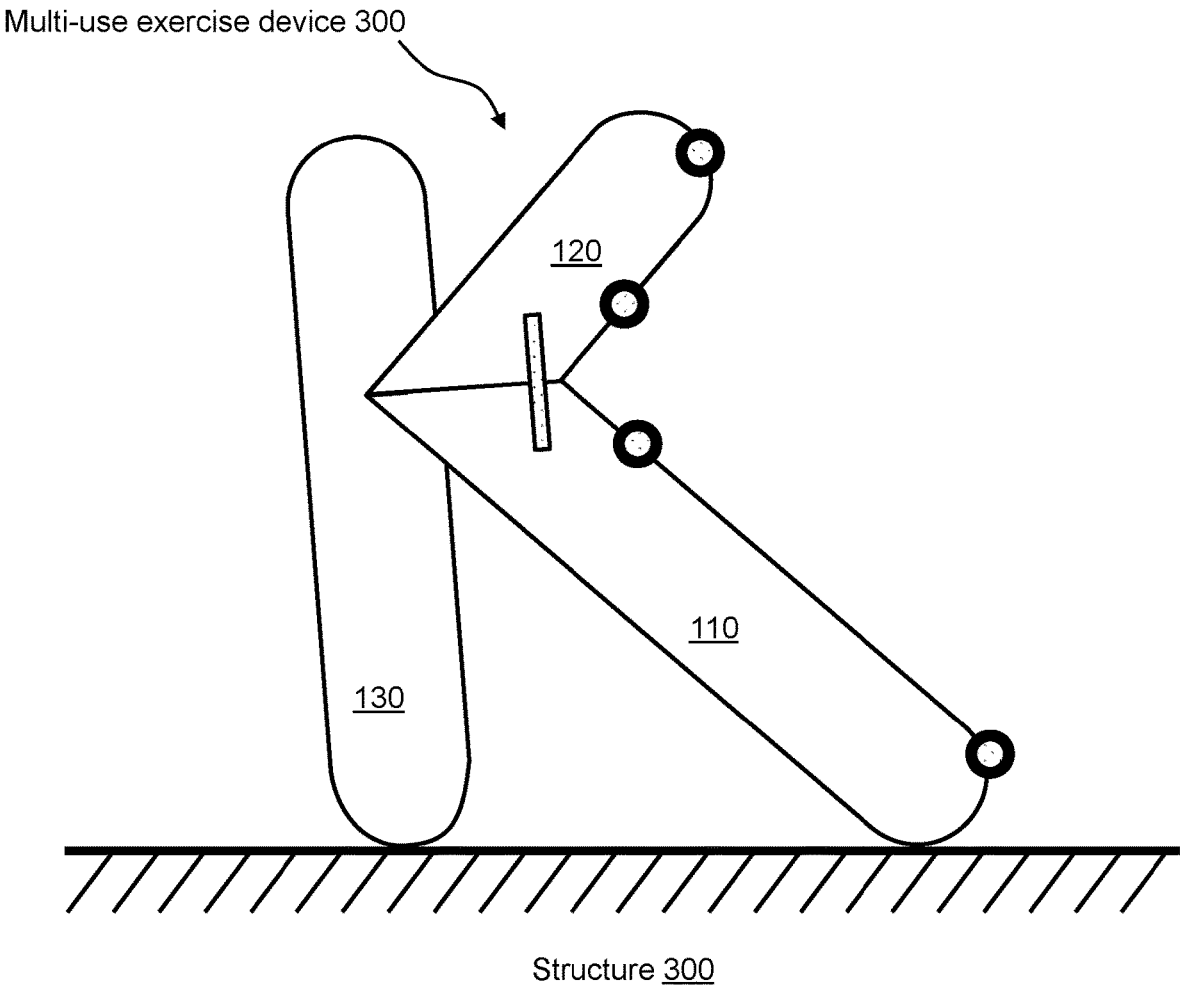
Figure 23:
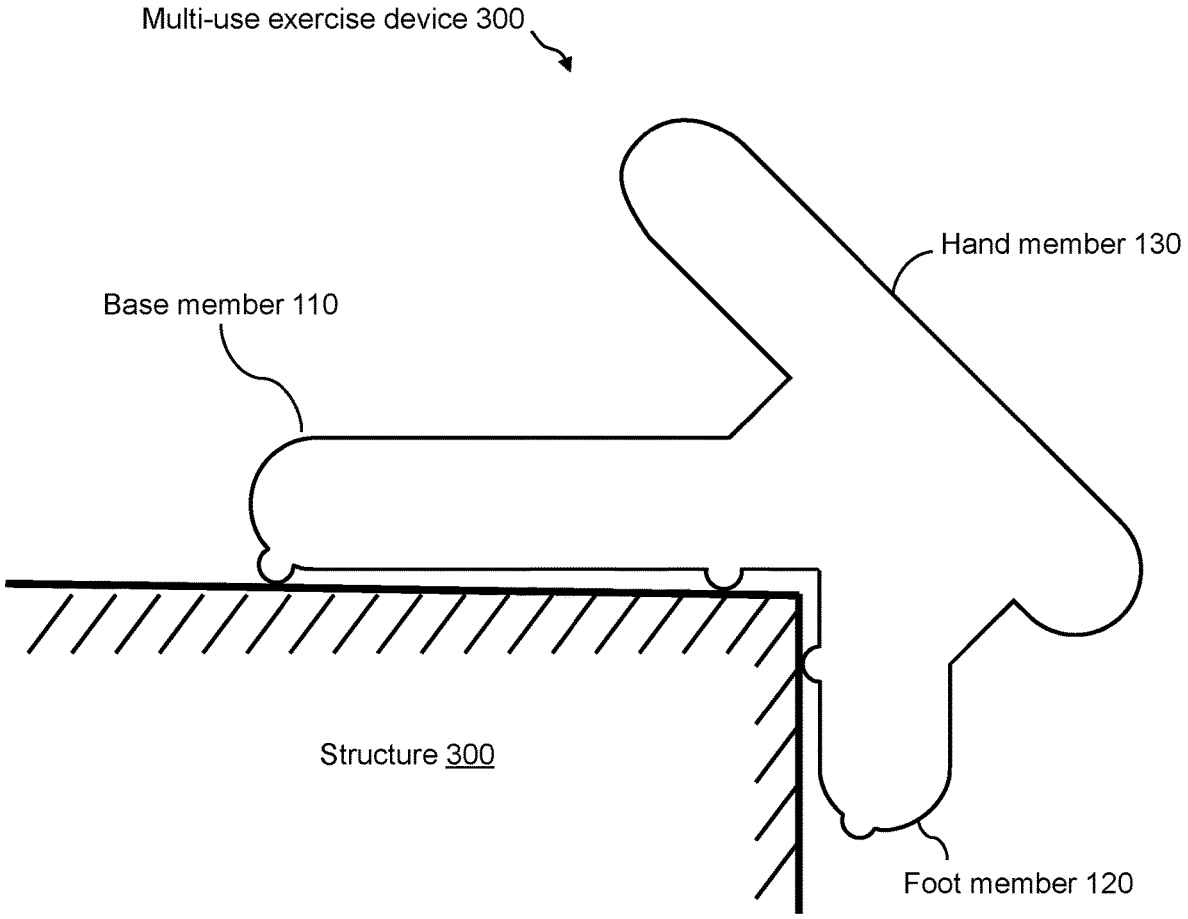
Figure 24A:
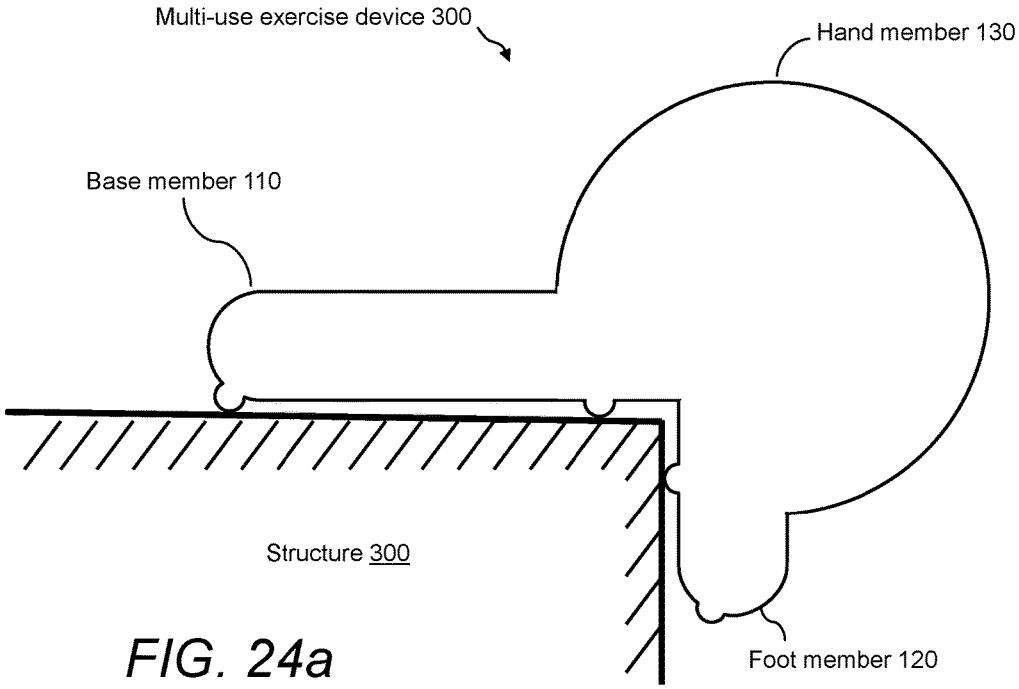
Figure 24B:
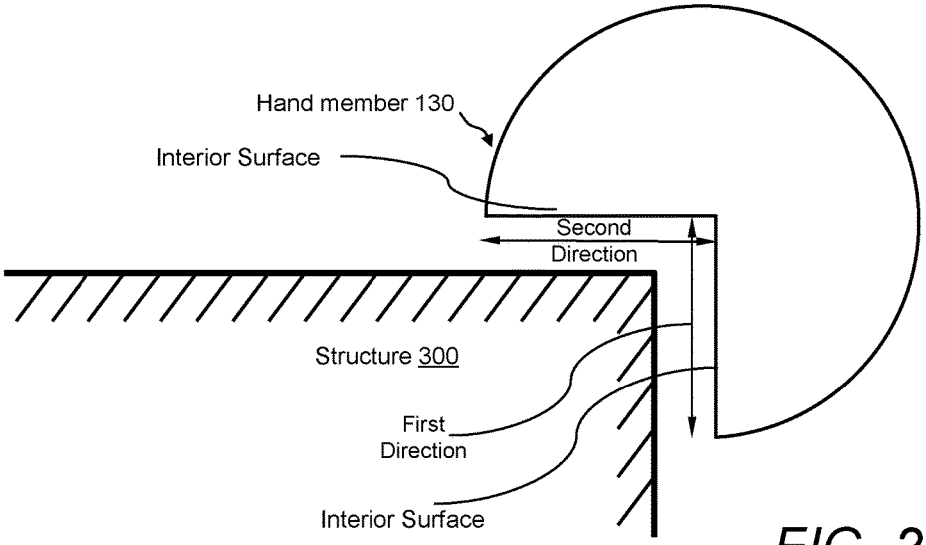

Having thus described the subject matter of the present invention in general terms, reference will now be made to the accompanying drawings, which are not necessarily drawn to scale, and wherein:

FIG. 1 and FIG. 2 illustrate an exploded side view and an assembled side view, respectively, of an example of the multi-use exercise device shown;

FIG. 3 illustrates detailed drawings of an example of the components of multi-use exercise device and showing example dimensions thereof;

FIG. 4 illustrates a side view showing more details of a hand member of the multi-use exercise device;

FIG. 5 illustrates a side view of an example of the multi-use exercise device, in accordance with another embodiment of the invention;

FIG. 6 illustrates detailed drawings of an example of the components of multi-use exercise device;

FIG. 7 illustrates a side view of an example of the multi-use exercise device in the "base flat to surface" position;

FIG. 8 illustrates a side view of an example of the multi-use exercise device in the "base and foot to surface" position;

FIG. 9 illustrates a side view of an example of the multi-use exercise device in the "hand flat to surface" position;

FIG. 10 illustrates a side view of an example of the multi-use exercise device in the "foot and hand to surface" position;

FIG. 11 illustrates a side view of an example of the multi-use exercise device in the "base and hand to surface" position;

FIG. 12 illustrates a flow diagram of an example of a method of using the multi-use exercise device, in accordance with an embodiment of the invention;

FIG. 13A and FIG. 13B illustrate side views of examples of the multi-use exercise device including a wireless battery charger, in accordance with an embodiment of the invention;

FIG. 14 illustrate a side view of multiple exercise devices utilized in combination;

FIG. 15 and FIG. 16 illustrate an exploded side view and an assembled side view, respectively, of an example of the multi-use exercise device;

FIG. 17 illustrates a side view showing more details of a hand member of the multi-use exercise device;

FIG. 18 illustrates a side view of an example of the multi-use exercise device in the "base and foot to surface" position;

FIG. 19 illustrates a side view of an example of the multi-use exercise device in the "base and foot to surface" position;

FIG. 20 illustrates a side view of an example of the multi-use exercise device in the "hand flat to surface" position;

FIG. 21 illustrates a side view of an example of the multi-use exercise device in the "foot and hand to surface" position;

FIG. 22 illustrates a side view of an example of the multi-use exercise device in the "base and hand to surface" position;

FIG. 23 shows a view of an example instantiation of the multi-use exercise device;

FIG. 24*a* shows a view of an example instantiation of the multi-use exercise device;

FIG. 24*b* shows a view of an example instantiation of the multi-use exercise device.

DETAILED DESCRIPTION

The subject matter of the present invention now will be described more fully hereinafter with reference to the accompanying drawings, in which some, but not all embodiments of the subject matter of the present invention are shown. Like numbers refer to like elements throughout. The subject matter of the present invention may be embodied in many different forms and should not be construed as limited to the embodiments set forth herein; rather, these embodiments are provided so that this disclosure will satisfy applicable legal requirements. Indeed, many modifications and other embodiments of the subject matter of the present invention set forth herein will come to mind to one skilled in the art to which the subject matter of the present invention pertains having the benefit of the teachings presented in the foregoing descriptions and the associated Drawings. Therefore, it is to be understood that the subject matter of the present invention is not to be limited to the specific embodiments disclosed and that modifications and other embodiments are intended to be included within the scope of the appended claims.

In some embodiments, the subject matter of the present invention provides a multi-use exercise apparatus and methods of using same. The multi-use exercise apparatus and methods of the invention may provide a means for performing both counter or standing push-ups and/or floor push-ups.

In some embodiments, the multi-use exercise apparatus and methods may provide a multi-use exercise device that may be sized to be held in one hand and wherein the user may use a pair of multi-use exercise devices for performing standing push-ups and floor push-ups.

In some embodiments, the multi-use exercise apparatus and methods may provide a multi-use exercise device that may include a base member or portion, a foot member or portion, and a hand member or portion.

In some embodiments, the multi-use exercise apparatus and methods may provide a multi-use exercise device that may include a base member, a foot member, and a hand member and wherein the foot member may be arranged substantially orthogonal to the base member and at one end of base member.

In some embodiments, the multi-use exercise apparatus and methods may provide a multi-use exercise device that may include a base member, a foot member, and a hand member and wherein the base member and the foot member may form an "L" shaped structure.

In some embodiments, the multi-use exercise apparatus and methods may provide a multi-use exercise device that may include a base member, a foot member, and a hand member and wherein the hand member may be arranged at an angle on the side of the base member that is opposite the foot member and wherein the hand member and the foot member may be arranged near the same end of the base member.

In some embodiments, the multi-use exercise apparatus and methods may provide a multi-use exercise device that may include a base member, a foot member, and a hand member and wherein the foot member may be arranged at, for example, in the range of about 90 degrees with respect to the base member and hand member may be arranged at, for example, in the range of about 45 degrees with respect to the base member.

In some embodiments, the multi-use exercise apparatus and methods may provide a multi-use exercise device that may have utility in various orientations and/or positions, such as (1) the "base and hand to surface" position, (2) the "foot and hand to surface" position, (3) the "hand flat to surface" position, (4) the "base and foot to surface" position, and (5) the "base flat to surface" position.

In some embodiments, the multi-use exercise apparatus and methods may provide certain features and/or benefits, such as, but not limited to, (1) a push-ups training devices; (2) push-ups devices that may be compact and portable; (3) push-ups devices to help improve a user's upper body health; (4) push-ups devices providing users with good control of push-ups and the ability to target different muscle group(s); (5) push-ups devices that may help reduce strain on a user's wrist; (6) push-ups devices that may benefit beginners by providing an option for a safe and comfortable platform for building strength; and (7) push-ups devices that provide a means to perform standing push-ups using an elevated surface or platform with an edge, such as a countertop, table top, desktop, and the like.

In some embodiments, the multi-use exercise apparatus and methods may provide a multi-use exercise device that may have an extended length and wherein the user may use one extended-length multi-use exercise device to perform standing push-ups and/or floor push-ups.

In some embodiments, the multi-use exercise apparatus and methods may provide a dual-purpose device that may be (1) a multi-use exercise device for performing counter or standing push-ups and/or floor push-ups; and/or (2) a mobile device stand for holding any mobile device, such as a mobile phone and tablet device.

Further, a method of using the multi-use exercise apparatus is provided.

Referring now to FIG. 1, an example of a multi-use exercise device 100 is illustrated in accordance with an embodiment of the invention. Multi-use exercise device 100 may include, for example, a base member 110, a foot member 120, and a hand member 130. Base member 110, foot member 120, and hand member 130 may be, for example, plate-shaped members that may be formed, for example, of wood, plastic (e.g., hard-plastic mold injection), metal (e.g., aluminum, steel), composite polymer-based materials, and the like. In the example of wooden and/or metal members, base member 110, foot member 120, and hand member 130 may be provided separately and then assembled, such as shown in FIG. 1 and FIG. 2. In the example of plastic members, base member 110, foot member 120, and hand member 130 may be formed together as one piece via an injection molding process. More details of an example of wooden multi-use exercise devices are shown and described hereinbelow. Hand member 130 may be, for example, ball-shaped members that may be formed, for example, of wood, plastic (e.g., hard-plastic mold injection), metal (e.g., aluminum, steel), composite polymer-based materials, and the like.

Referring now to FIG. 1 and FIG. 2 is an exploded side view and an assembled side view, respectively, of an example of the multi-use exercise device 100. In this example, foot member 120 may be arranged substantially orthogonal to base member 110 and at one end of base member 110. Particular to wooden members, base member 110 may include a groove 112 for receiving a tongue 122 of foot member 120. Together, base member 110 and foot member 120 form an "L" shaped structure. Hand member 130 may be arranged at an angle on the side of base member 110 that is opposite foot member 120. Foot member 120 and hand member 130 may be arranged near the same end of base member 110. Foot member 120 may include a notch 132 for receiving a corner edge of base member 110. The foot member 120 may be arranged at an angle a1 with respect to base member 110. In one example, the angle a1 may be in the range of about 90 degrees. The hand member 130 may be arranged at an angle a2 with respect to base member 110. In one example, the angle a2 may be in the range of about 45 degrees.

In an embodiment, the multi-use exercise device 100, may include one or more wedges 140. The one or more wedges 140 may provide additional structural support of multi-use exercise device 100. For example, optionally, multi-use exercise device 100 may include a wedge 140 at the outer intersection of base member 110, foot member 120, and hand member 130. Further, optionally, multi-use exercise device 100 may include a wedge 140 at the inner intersection of base member 110 and hand member 130. Further, optionally, multi-use exercise device 100 may include a wedge 140 at both locations.

Referring now to FIG. 3 is detailed drawings of an example of the components of multi-use exercise device 100 and showing example dimensions thereof. In one example, the overall width of multi-use exercise device 100 may be in the range of about 4 inches. In this example, base member 110 may be in the range of about 4 inches wide, in the range of about 4 inches long, and in the range of about 0.75 inches thick. Foot member 120 may be in the range of about 4 inches wide, in the range of about 1.25-1.5 long (excluding tongue 122), and in the range of about 0.75 inches thick. Hand member 130 may be in the range of about 4 inches wide, in the range of about 3 inches long, and in the range of about 0.75 inches thick.

Referring now to FIG. 4 is a side view showing more details of hand member 130 of the multi-use exercise device 100. In particular, FIG. 4 shows more details of notch 132 of hand member 130. FIG. 4 shows that the sides of notch 132 may be arranged at angles a3 with respect to the side of base member 110. In one example, the angles a3 may be in the range of about 135 degrees.

Referring now to FIG. 5 is a side view of an example of a multi-use exercise device 200, in accordance with another embodiment of the invention. Further, FIG. 6 is detailed drawings of an example of the components of multi-use exercise device 200 shown in FIG. 5. In this example, multi-use exercise device 200 may include certain rounded edges for improved comfort and/or aesthetics.

Additionally, with respect to forming any multi-use exercise device, multiple types of joints or other techniques or mechanisms are possible for coupling together base member 110, foot member 120, and/or hand member 130. In a non-limiting example, the multi-use exercise device may include a lock miter joint for coupling base member 110 and foot member 120. For example, base member 110 may include a lock miter joint 212. Further, foot member 120 may include a lock miter joint 222 and wherein lock miter joint 222 is designed to mate with lock miter joint 212 of base member 110. Lock miter joints 212, 222 may be, for example, in the range of about 45-degree lock miter joints multi-use exercise device 300 and may include a miter butt joint for coupling base member 110 and foot member 120. For example, base member 110 may include a groove 113. Further, foot member 120 may include a groove 114 and wherein a biscuit is sandwiched in the range of about 45-degree lock miter joints.

The multi-use exercise devices of the invention may include different surface size, topology, geometric form, bar, angle, swiveling, depth, materials, and the like. Additionally, the multi-use exercise devices of the invention are not limited to the tongue and groove joint lock miter joint, or miter butt joint. These are exemplary only. Other types of joints or coupling techniques or mechanisms are possible in the multi-use exercise devices of the invention.

The multi-use exercise device of the invention, such as multi-use exercise devices 100, 200, 300 may have utility in various orientations and/or positions.

In one example, FIG. 7 shows multi-use exercise device 200 in the "base flat to surface" position. In this position, the L-shape of base member 110 and foot member 120 may be engaged in relation to the edge of a structure 300. In this example, structure 300 may be any elevated surface or platform with an edge, such as a countertop, table top, desktop, and the like. In this example, base member 110 is flat atop the countertop and while foot member 120 is flat against the front edge of the countertop. In the "base flat to surface" position, hand member 130 extends upward and provides the grip portion of multi-use exercise device 200. Further, in the "base flat to surface" position, hand member 130 may be, for example, in the range of about 45 degrees from horizontal.

In another example, FIG. 8 shows multi-use exercise device 200 in the "base and foot to surface" position. In this position, base member 110 and foot member 120 provide the legs or feet of multi-use exercise device 200 for sitting atop a flat structure 300. Flat structure 300 may be any flat surface, such as the floor. In the "base and foot to surface" position, hand member 130 extends upward and provides the grip portion of multi-use exercise device 200.

In yet another example, FIG. 9 shows multi-use exercise device 200 in the "hand flat to surface" position. In this position, hand member 130 is placed flat atop structure 300 and with base member 110 and foot member 120 extending upward. In the "hand flat to surface" position, base member 110 and foot member 120 of multi-use exercise device 200 may provide a cradle for holding, for example, a mobile device.

In yet another example, FIG. 10 shows multi-use exercise device 200 in the "foot and hand to surface" position. In this position, foot member 120 and hand member 130 provide the legs or feet of multi-use exercise device 200 for sitting atop structure 300. In the "foot and hand to surface" position, base member 110 and hand member 130 of multi-use exercise device 200 may provide a cradle for holding, for example, a mobile device. In this example, multi-use exercise device 200 may hold the mobile device at a more upright angle as compared with the "hand flat to surface".

In still another example, FIG. 11 shows multi-use exercise device 200 in the "base and hand to surface" position. In this position, base member 110 and hand member 130 provide the legs or feet of multi-use exercise device 200 for sitting atop structure 300 and with foot member 120 extending upward.

Referring now to FIG. 12 is a flow diagram of an example of a method 400 of using the multi-use exercise device 100, 200, 300 in accordance with an embodiment of the invention. Method 400 may include, but is not limited to, the following steps.

At a step 410, a pair of multi-use exercise devices are provided in accordance with an embodiment of the invention.

At a step 415, a user selects the orientation or position of the multi-use exercise devices for performing push-ups. In one example, a user 305 desiring to perform counter or standing push-ups with respect to a countertop surface may hold the multi-use exercise devices 100 or 200 in the "base flat to surface" position. In another example, a user 305 desiring to perform floor push-ups with respect to a floor surface may hold the multi-use exercise devices 100 or 200 in the "base and foot to surface" position.

At a step 420, the user grasps the multi-use exercise devices and then places them on a surface for the desired type of push-ups. In one example, user 305 grasps the pair of multi-use exercise devices 100 or 200 and then places them in the "base flat to surface" position against the edge of the countertop for performing counter or standing push-ups;

At a step 425, the multi-use exercise devices are used to perform standing or floor push-ups.

Referring now to FIG. 13A and FIG. 13B each present side views of examples of multi-use exercise device 200 including a wireless battery charger, in accordance with an embodiment of the invention. For example, a disc-shaped wireless charger 250 may be installed on one or more surfaces of base member 110 of multi-use exercise device 200. The overall size and/or dimensions of the multi-use exercise device (e.g., multi-use exercise devices 100, 200, 300) may be adjusted to hold a certain wireless charger 250.

In one example, FIG. 13A shows multi-use exercise device 200 in the "hand flat to surface" position and with wireless charger 250 installed on the foot member 120-side of base member 110.

FIG. 14 shows a side view of an example of an extender 900 used in combination with any multi-use exercise device of the invention, such as with multi-use exercise devices 200. Extender 900 may be, for example, multi-use exercise device 100 or 200 absent hand member 130 to form a simple L-shaped structure. Extender 900 may be designed to be fitted beneath multi-use exercise device 100 or 200 at the edge of a countertop and with multi-use exercise device 100 or 200 in the "base flat to surface" position.

When in use, extender 900 may be placed, wedged, hooked, or otherwise inserted between base member 110 and foot member 120 of multi-use exercise device 100 or 200 and the countertop. The purpose of extender 900 may be to increase the distance of multi-use exercise devices 100, 200, 300 from the countertop, allowing advanced users to perform a deeper push-up.

Referring to FIG. 15, a foot member having an interior surface extending a first length in a first direction;

- a base member having an interior surface extending a second length in a second direction orthogonal to the first direction to contact the interior surface of the foot member;
- an interior notch formed by the contact of the interior surface of the foot member and the interior surface of the base member;
- a hand member coupled to the base member and to the foot member opposite the interior notch and extending in a third direction to define an oblique angle with the interior surface of the foot member and with the interior surface of the base member.

Referring now to FIG. 15 and FIG. 16 is an exploded side view and an assembled side view, respectively, of an example of the multi-use exercise device 300. In this example, foot member 120 may be arranged substantially orthogonal to base member 110 and at one end of base member 110. Particular to wooden members, base member 110 may include a groove 113, and foot member 120 may include a groove 114 for inserting biscuit 112. Together, base member 110 and foot member 120 form an "L" shaped structure. Hand member 130 may be arranged at an angle on the side of base member 110 that is opposite foot member 120. Foot member 120 and hand member 130 may be arranged near the same end of base member 110. FIG. 16 shows that foot member 120 may be arranged at an angle a1 with respect to base member 110. In one example, the angle a1 may be in the range of about 90 degrees. FIG. 16 also shows that hand member 130 may be arranged at an angle a2 with respect to base member 110. In one example, the angle a2 may be in the range of about 45 degrees.

Referring still to FIG. 15 and FIG. 16, optionally, multi-use exercise device 300 may include one or more notch 133, notch 134 at the bottom of the base member 110. Furthermore, optionally, multi-use exercise device 300 may include one or more notch 135, notch 136 at the inside side of foot member 120. The one or more notches 133 through notch 136 are designed to house an anti-slip material such as rubber and an example. The one or more notches 133 to notch through notch 136 may provide additional anti-slip support to multi-use exercise device 300. For example, optionally, multi-use exercise device 300 may include eliminate the notches 133 through notch 136 and use a stick-on anti-slip material on all or any of base member 110 and or foot member 120, respectively.

Referring now to FIG. 16 is a side view of an example of a multi-use exercise device 300, in accordance with another embodiment of the invention. Further, FIG. 41 is detailed drawings of an example of the components of multi-use exercise device 300 shown in FIG. 40. In this example, multi-use exercise device 300 may be substantially the same as multi-use exercise device 100 that may include certain rounded edges for improved comfort and/or aesthetics and/or anti-slip materials.

Referring now to FIG. 17 is detailed drawings of an example of the components of multi-use exercise device 300 and showing example dimensions thereof. In one example, the overall width of multi-use exercise device 300 may be in the range of about 4 inches. In this example, base member 110 may be in the range of about 4 inches wide, in the range of about 4 inches long, and in the range of about 0.75 inches thick. Foot member 120 may be in the range of about 4 inches wide, in the range of about 1.25-2.5 long and in the range of about 0.75 inches thick. Hand member 130 may be in the range of about 4 inches wide, in the range of about 3.7 inches long, and in the range of about inches thick.

The multi-use exercise device of the invention, such as multi-use exercise devices 100, 200, 300 may have utility in various orientations and/or positions.

In one example, FIG. 18, respectively, shows multi-use exercise device 300 in the "base flat to surface" position. In this position, the L-shape of base member 110 and foot member 120 may be engaged in relation to the edge of a structure 300. In this example, structure 300 may be any elevated surface or platform with an edge, such as a countertop, table top, desktop, and the like. In this example, base member 110 is flat atop the countertop and while foot member 120 is flat against the front edge of the countertop. In the "base flat to surface" position, hand member 130 extends upward and provides the grip portion of multi-use exercise device 300. Further, in the "base flat to surface" position, hand member 130 may be, for example, in the range of about 45 degrees from horizontal.

In another example, FIG. 19 shows multi-use exercise device 300 in the "base and foot to surface" position. In this position, base member 110 and foot member 120 provide the legs or feet of multi-use exercise device 300 for sitting atop a flat structure 300. Flat structure 300 may be any flat surface, such as the floor. In the "base and foot to surface" position, hand member 130 extends upward and provides the grip portion of multi-use exercise device 300. An example of the "base and foot to surface" position.

In yet another example, FIG. 20 shows multi-use exercise device 300 in the "hand flat to surface" position. In this position, hand member 130 is placed on flat top structure 300 and with base member 110 and foot member 120 extending upward. In the "hand flat to surface" position, base member 110 and foot member 120 of multi-use exercise device 300 may provide a cradle for holding, for example, a mobile device.

In yet another example, FIG. 21 shows multi-use exercise device 300 in the "foot and hand to surface" position. In this position, foot member 120 and hand member 130 provide the legs or feet of multi-use exercise device 300 for sitting atop structure 300. In the "foot and hand to surface" position, base member 110 and hand member 130 of multi-use exercise device 300 may provide a cradle for holding, for example, a mobile device. In this example, multi-use exercise device 300 may hold the mobile device at a more upright angle as compared with the "hand flat to surface" position.

In still another example, FIG. 22 shows multi-use exercise device 300 in the "base and hand to surface" position. In this position, base member 110 and hand member 130 provide the legs or feet of multi-use exercise device 300 for sitting atop structure 300 and with foot member 120 extending upward.

Referring now to FIG. 23 is a view of an example instantiation of the multi-use exercise device 100, 200, 300. In this example, multi-use exercise device 100, 200, 300, base member 110, foot member 120, hand member 130, wedge 140, may be, for example, members that may be formed, for example, of wood, plastic (e.g., hard-plastic mold injection), metal (e.g., aluminum, steel), composite polymer-based materials, and the like.

Referring now to FIG. 24*a*, FIG. 24*b* is a view of an example instantiation of the multi-use exercise device 100, 200, 300. In this example, multi-use exercise device 300 hand member 130 is a ball-shaped, may be, used to be attached to base member 110 and foot member 120 as shown in FIG. 24*a*, or used as simplified stand-alone example of the device 100, 200, 300, as shown in FIG. 24*b*.

Referring now to FIG. 24*b*, in this example, multi-use exercise device 300 hand member 130 is a ball-shaped. In this example, multi-use exercise device 300, foot member is considered the interior surface of hand member 130 extending a first length in a first direction;

a base member is considered the interior surface of hand member 130 extending a second length in a second direction orthogonal to the first direction of the interior surface of the hand member 130;

an interior notch formed of the first length in a first direction and the second length in a second direction.

Referring still to FIG. 24*b*, in this example, multi-use exercise device 300 hand member 130, may have, anti-slip materials at the first length in a first direction and/or on the second length in a second direction.

In summary and referring now again to FIG. 1 through FIG. 24, multi-use exercise device 100, 200, 300, 500 and method 400 of the invention may provide a means for performing both counter or standing push-ups and/or floor push-ups.

In some embodiments, multi-use exercise device 100, 200, 300 may be sized to be held in one hand and wherein the user may use a pair of multi-use exercise devices 100, 200, 300 for performing counter or standing push-ups and/or floor push-ups.

In some embodiments, multi-use exercise device 500 may have an extended length and wherein the user may use one extended-length multi-use exercise device 500 for performing counter or standing push-ups and/or floor push-ups.

In some embodiments, multi-use exercise device 100, 200, 300, 500 and method 400 may provide a multi-use exercise device that may have utility in various orientations and/or positions, such as (1) the "base and hand to surface" position, (2) the "foot and hand to surface" position, (3) the "hand flat to surface" position, (4) the "base and foot to surface" position (see FIG. 11), and (5) the "base flat to surface" position.

In some embodiments, multi-use exercise device 100, 200, 300, 500 and method 400 of the invention may provide certain features and/or benefits, such as, but not limited to, (1) a push-ups training devices; (2) push-ups devices that may be compact and portable; (3) push-ups devices to help improve a user's upper body health; (4) push-ups devices providing users with good control of push-ups and the ability to target different muscle group(s); (5) push-ups devices that may help reduce strain on a user's wrist; (6) push-ups devices that may benefit beginners by providing an option for a safe and comfortable platform for building strength; and (7) push-ups devices that provide a means for performing counter or standing push-ups using an elevated surface or platform with an edge, such as a countertop, table top, desktop, and the like.

In some embodiments, multi-use exercise device 100, 200, 300, 500 and method 400 of the invention may provide a dual-purpose device that may be (1) a multi-use exercise device for performing counter or standing push-ups and/or floor push-ups; and/or (2) a mobile device stand for holding any mobile device, such as a mobile phone and tablet device.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the subject matter of the present invention. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. An apparatus comprising:

a foot member having a first length in a first direction and a vertical tongue at a proximal end of said foot member;

a base member having an interior surface extending a second length in a second direction orthogonal to the first direction and having a groove adjacent to a distal end of said base member;

said foot member vertical tongue joined to said base member groove at a 90 degree angle;

a hand member having a length equal to or greater than half the second length of said base member;

said hand member having a notch adjacent to a proximal end of said hand member; and said hand member coupled to the base member and to the foot member opposite the groove of said base member and extending in a third direction to define an oblique angle with an interior surface of the foot member and with the interior surface of the base member.

2. The apparatus of claim 1, wherein said foot member is approximately one half the second length of the base member.

3. The apparatus of claim 1, wherein said base member and said foot member further comprise anti-slip members respectively attached to external surfaces of said base member and said foot member.

4. The apparatus of claim 3, wherein said anti-slip members are respectively inserted into notches created in the external surfaces of said base member and said foot member.

5. The apparatus of claim 1, wherein said hand member notch is located approximately two thirds of the length of said hand member from a distal end of said hand member.

6. The apparatus of claim 1, further comprising one or more wedges placed and in contact between said hand member and each of said foot member and said base member to support a position of said hand member in relation to said foot member and said base member.

* * * * *